US010825302B2

(12) United States Patent
Baerlocher et al.

(10) Patent No.: US 10,825,302 B2
(45) Date of Patent: Nov. 3, 2020

(54) AUGMENTED REALITY TICKET EXPERIENCE

(71) Applicant: IGT, Las Vegas, NV (US)

(72) Inventors: Anthony Baerlocher, Henderson, NV (US); Dwayne Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 44 days.

(21) Appl. No.: 16/184,820

(22) Filed: Nov. 8, 2018

(65) Prior Publication Data

US 2020/0152018 A1 May 14, 2020

(51) Int. Cl.
*G07F 17/32* (2006.01)

(52) U.S. Cl.
CPC ..... *G07F 17/3288* (2013.01); *G07F 17/3211* (2013.01)

(58) Field of Classification Search
CPC ..... G07F 17/3288; G07F 17/3211
See application file for complete search history.

(56) References Cited

U.S. PATENT DOCUMENTS 8,235,529 B1 8/2012 Raffle et al.
8,558,759 B1 10/2013 Prada et al.
8,821,274 B2 9/2014 Lyons et al.
8,943,420 B2 1/2015 Goldthwaite et al.
9,280,867 B2 3/2016 Froy et al.
9,280,868 B2 3/2016 Froy et al.
9,285,592 B2 3/2016 Olsson et al.
9,412,201 B2 8/2016 Kinnebrew et al.
9,558,612 B2 1/2017 Lyons et al.
9,568,620 B2 1/2017 Froy et al.
9,569,920 B2 2/2017 Froy et al.
2011/0065496 A1* 3/2011 Gagner ..... G07F 17/3209 463/25
2012/0184352 A1* 7/2012 Detlefsen ..... G07F 17/3225 463/25
2012/0244939 A1* 9/2012 Braun ..... G06K 9/228 463/31
2013/0210523 A1* 8/2013 Arumugam ..... G07F 17/3218 463/31
2013/0281206 A1* 10/2013 Lyons ..... G07F 17/3211 463/33
2013/0281207 A1* 10/2013 Lyons ..... G07F 17/3206 463/33

(Continued)

*Primary Examiner* — Chase E Leichliter
(74) *Attorney, Agent, or Firm* — Sage Patent Group

(57) ABSTRACT

A system includes a communication interface, a processing circuit and a memory coupled to the processing circuit. The memory includes instructions that cause the processing circuit to receive, via the communication interface and from an augmented reality (AR) device, real-time image data of a code data portion of a wagering ticket that corresponds to a wagering event. Based on the code data portion of the wagering ticket, AR display content that is associated with the wagering event and that is viewable by a user of the AR device is determined. The AR device is caused to display the AR content that is associated with the wagering event. A combined image corresponds to an image of the wagering ticket that is viewable through the AR device and the AR display content that is associated with the wagering event.

20 Claims, 18 Drawing Sheets

(56) References Cited

U.S. PATENT DOCUMENTS

| | | | | |
|---|---|---|---|---|
| 2013/0281209 | A1* | 10/2013 | Lyons | A63F 13/53 463/33 |
| 2014/0100896 | A1* | 4/2014 | Du | G07B 11/00 705/5 |
| 2014/0121015 | A1 | 5/2014 | Massing et al. | |
| 2014/0168261 | A1 | 6/2014 | Margolis et al. | |
| 2015/0065219 | A1* | 3/2015 | Kiely | G07F 17/3225 463/13 |
| 2015/0126279 | A1* | 5/2015 | Lyons | G07F 17/323 463/33 |
| 2015/0228148 | A1* | 8/2015 | Barnes | G06T 19/006 463/17 |
| 2016/0019746 | A1* | 1/2016 | Lyons | G07F 17/3211 463/25 |
| 2016/0196719 | A1* | 7/2016 | Rosenheimer | G07F 17/3223 463/17 |
| 2016/0373570 | A1 | 12/2016 | Scavezze et al. | |
| 2018/0089927 | A1* | 3/2018 | Anderson | G06T 19/006 |
| 2019/0114871 | A1* | 4/2019 | Garrison | G07F 17/3248 |
| 2019/0272701 | A1* | 9/2019 | Mohan | G07F 17/3211 |

* cited by examiner

AUGMENTED REALITY TICKET EXPERIENCE

BACKGROUND

Embodiments described herein relate to augmented reality systems and methods, and in particular to gaming enterprises that use tickets to memorialize a wager and/or a wager outcome.

Wagering tickets may be used in a variety of ways in gaming. One example includes a ticket-in-ticket-out system for depositing value into and retrieving value from an electronic gaming machine (EGM). Another example includes sports betting in which a wager placed on a particular sporting event outcome may be memorialized using a wagering ticket that is given to the bettor at the time the wager is made. In the case of a winning wager, the wagering ticket may be redeemed by the player to collect the winnings. Other wagering tickets include lottery tickets that may be used to implement a number of different types of lottery games.

BRIEF SUMMARY

A system includes a communication interface, a processing circuit, and a memory coupled to the processing circuit. The memory includes machine readable instructions that, when executed by the processing circuit, cause the processing circuit to receive, via the communication interface and from an augmented reality (AR) device, real-time image data of a code data portion of a wagering ticket that corresponds to a wagering event. The processing circuit further determines, based on the code data portion of the wagering ticket, AR display content that is associated with the wagering event and that is viewable by a user of the AR device and causes the AR device to display the AR display content that is associated with the wagering event. A combined image corresponds to an image of the wagering ticket that is viewable through the AR device and the AR display content that is associated with the wagering event.

An AR system includes a processing circuit, a transceiver coupled to the processing circuit, and a display device coupled to the processing circuit and that the processing circuit causes to display the AR display content within a field of view of a user when the user is viewing image data of a code data portion of a wagering ticket that corresponds to a wagering event. The AR display content includes a graphic that corresponds to the wagering event. A combined image corresponds to an image of the wagering ticket that is viewable through the AR device and the AR display content that is associated with the wagering event.

Some embodiments are directed to methods that include receiving, via a communication interface and from an augmented reality (AR) device, real-time image data of a code data portion of a wagering ticket that corresponds to a wagering event, determining, based on the code data portion of the wagering ticket and a status of the wagering event, AR display content that is associated with the wagering event and that is viewable by a user of the AR device, and causing the AR device to display the AR display content that is associated with the wagering event. The status of the wagering event includes a first wagering event state that is before the wagering event has commenced, a second wagering event state that is during the wagering event and a third wagering event state that is after the wagering event has ended. The AR display content includes a first AR display content responsive to the status being the first wagering event state, a second AR display content responsive to the status being the second wagering event state and a third AR display content responsive to the status being the third wagering event state. A combined image corresponds to an image of the wagering ticket that is viewable through the AR device and the AR display content that is associated with the wagering event.

DETAILED DESCRIPTION

Figure 1:
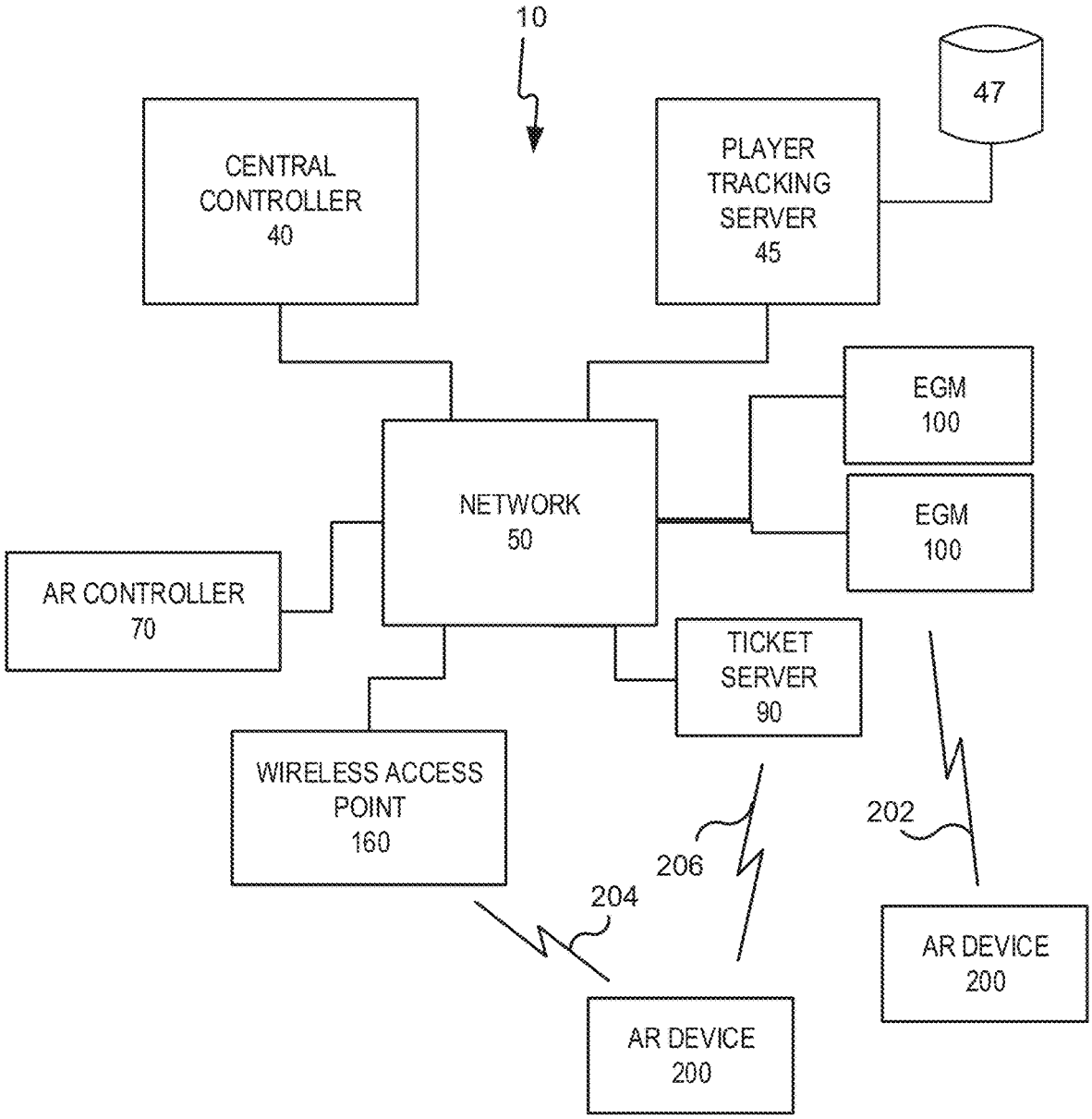
FIG. 1 is a schematic block diagram illustrating a network configuration for a plurality of gaming devices according to some embodiments.

It may be advantageous to encourage users to retain wagering tickets longer to increase opportunities for the user to stay involved in gaming activities. As such, inventive concepts herein provide a technological solution using augmented reality (AR) to increase wagering ticket retention and user enjoyment thereof.

Embodiments of the inventive concepts provide systems, methods and apparatus for providing AR display content corresponding to wagering tickets. The AR display content may be displayed on or in connection with code data that is on a printed wagering ticket. For example, a user may have an AR device, such as a mobile terminal, smartphone, headset, AR glasses and/or AR contact lenses among others. The AR device may read a wagering ticket and then present an AR experience on the wagering ticket. The experience may be an entertaining display that is related to the wagering game and/or a mini-game that the user may play.

In some embodiments, the wagering ticket may include a cash out ticket that was printed by a gaming device, such as an electronic gaming machine (EGM). Some other embodiments provide that the waging ticket is a ticket that a receipt corresponding to a wager place on a sporting or other type of event. In some embodiments, the wagering ticket may include a ticket corresponding to a lottery type game.

The AR experience may include an interactive AR experience such as a game and may increase a value of the wagering ticket based on the interaction. For example, the value may be increased in the currency that the wagering ticket represents and/or in another manner such as increased bonus points and/or free or reduced price products, such as consumables like food and drink.

Embodiments herein may provide additional incentives for the user to return to a gaming device and/or to engage another gaming device instead of redeeming the wagering ticket. In this manner, the AR experience corresponding to the wagering ticket may increase the user's enjoyment and/or level of engagement with gaming devices.

In some embodiments, an AR system may use the information read from the code data portion of the wagering ticket to communicate with a host system to identify which gaming devices are enabled and/or allowed for the wagering ticket. The AR system may present an award that may be available if the user players the identified gaming devices and may modify the value of the ticket based on the outcome of the game. If the player wins, the AR system may notify the host system and the host system may record the new value of the wagering ticket. The wagering ticket may then include the modified value that can be redeemed at a kiosk, cash cage and/or gaming device.

In some embodiments, the user may log into a gaming device that includes wireless access to a user's account. In such embodiments, the AR system may allow the user to play an AR game on the wagering ticket prior to inserting the wagering ticket into the gaming device based on being logged into the user's account. Depending on the outcome of the AR game, the value of the wagering ticket may be increased. In some embodiments, the AR game may include a double up feature in which, based on the outcome of the AR game, the value of the wagering ticket may be worth double or worth nothing. Some embodiments provide that the user places a wager to play the AR game. The wager amount may be taken from the value of the wagering ticket and/or may be funded by a player account. This may provide the user with additional incentive to use the ticket again instead of redeeming the ticket. Some embodiments provide that incentive is also provided for the user to use the ticket at specific gaming devices that support the wireless access to the user's account.

Additionally, since a service provider of the user's account may be connected to a host system, awards based on the AR system may be regulated. For example, wagering tickets that may be associated with the AR experience may be limited based on the amount of play, the amounts wagered and/or the original value of the ticket.

Some embodiments provide that using the AR device on the wagering ticket while not connected to the user's account may include providing instructions to visit a given gaming device and/or type of gaming device to possibly increase the value of the wagering ticket.

In some embodiments, an AR event and/or payout may be affected by the gaming device and/or theme thereof. For example, using the wagering ticket at a first type of gaming device may provide better rewards than using the wagering ticket at a second type of gaming device. The rewards corresponding to an AR event may also vary based on theme and/or manufacturer of the gaming device.

The AR display content may be a simple animation that may randomly award values. In some embodiments, an AR event may begin at a first location and may include information that instructs the user to go to a different location, for example an open area on a casino floor or other gaming device. Once at the area, the AR device may display AR display content that includes multiple virtual items that the user can select from to reveal a prize.

Some embodiments provide that the wagering tickets may be printed using a dual port printer that may print wagering tickets that are not AR capable and wagering tickets that are AR capable. These and other embodiments are described in more detail below.

Augmented Reality EGM Systems and Viewers

Referring to FIG. 1, a gaming system 10 including a plurality of EGMs 100 is illustrated. As discussed above, the EGMs 100 may be one type of a variety of different types of gaming devices. The gaming system 10 may be located, for example, on the premises of a gaming establishment, such as a casino. The EGMs 100, which are typically situated on a casino floor, may be in communication with each other and/or at least one central controller 40 through a data communication network 50 that may include a remote communication link. The data communication network 50 may be a private data communication network that is operated, for example, by the gaming facility that operates the EGMs 100. Communications over the data communication network 50 may be encrypted for security. The central controller 40 may be any suitable server or computing device which includes at least one processing circuit and at least one memory or storage device. Each EGM 100 may include a processing circuit that transmits and receives events, messages, commands or any other suitable data or signal between the EGM 100 and the central controller 40. The EGM processing circuit is operable to execute such communicated events, messages or commands in conjunction with the operation of the EGM 100. Moreover, the processing circuit of the central controller 40 is configured to transmit and receive events, messages, commands or any other suitable data or signal between the central controller 40 and each of the individual EGMs 100. In some embodiments, one or more of the functions of the central controller 40 may be performed by one or more EGM processing circuits. Moreover, in some embodiments, one or more of the functions of one or more EGM processing circuits as disclosed herein may be performed by the central controller 40.

A wireless access point 160 provides wireless access to the data communication network 50. The wireless access point 160 may be connected to the data communication network 50 as illustrated in FIG. 1, or may be connected directly to the central controller 40 or another server connected to the data communication network 50.

A player tracking server 45 may also be connected through the data communication network 50. The player tracking server 45 may manage a player tracking account that tracks the player's gameplay and spending and/or other player preferences and customizations, manages loyalty awards for the player, manages funds deposited or advanced on behalf of the player, and other functions. Player information managed by the player tracking server 45 may be stored in a player information database 47.

As further illustrated in FIG. 1, the gaming system 10 may include a ticket server 90 that is configured to print and/or dispense wagering tickets. The ticket server 90 may be in communication with the central controller 40 through the data network 50. Each ticket server 90 may include a processing circuit that transmits and receives events, messages, commands or any other suitable data or signal between the ticket server 90 and the central controller 40. The ticket server 90 processing circuit may be operable to execute such communicated events, messages or commands in conjunction with the operation of the ticket server 90. Moreover, in some embodiments, one or more of the functions of one or more ticket server 90 processing circuits as disclosed herein may be performed by the central controller 40.

As further illustrated in FIG. 1, an AR device 200, is provided. The AR device 200 communicates with one or more elements of the gaming system 10 to render two-dimensional (2D) and/or three-dimensional (3D) content to a player of one of the EGMs 100 and/or the ticket server 90 in a virtual space, while at the same time allowing the player to see objects in the real space around the player. That is, the AR device 200 combines a virtual image from AR display content with real images perceived by the user, including images of real objects as well as objects printed on the wagering ticket. In this manner, the AR device 200 "mixes" real and virtual reality into a single viewing experience for the player. In some embodiments, the AR device 200 may be further configured to enable the player to interact with both the real and virtual objects displayed to the player by the AR device 200.

The AR device 200 communicates with one or more elements of the system 10 to coordinate the rendering of mixed reality images. For example, in some embodiments, the AR device 200 may communicate directly with the ticket server 90 over a wireless interface 202, which may be a WiFi link, a Bluetooth link, an NFC link, etc. In other embodiments, the AR device 200 may communicate with the data communication network 50 (and devices connected thereto, including EGMs and the coin pusher) over a wireless interface 204 with the wireless access point 160. The wireless interface 204 may include a WiFi link, a Bluetooth link, an NFC link, etc. In still further embodiments, the AR device 200 may communicate simultaneously with both the ticket server 90 over the wireless interface 206 and the wireless access point 160 over the wireless interface 204. Some embodiments provide that AR device 200 may communicate with one or more of the EGMs 100 over a wireless interface 202. In these embodiments, wireless interface 202, wireless interface 204 and wireless interface 206 may use different communication protocols and/or different communication resources, such as different frequencies, time slots, spreading codes, etc. For example, in some embodiments, the wireless interface 202 may be a Bluetooth link, while the wireless interface 204 and/or 206 may be a WiFi link.

The wireless interfaces 202, 204, 206 allow the AR device 200 to coordinate the generation and rendering of mixed reality images to the player via the AR device 200.

In some embodiments, the gaming system 10 includes a mixed reality controller, or AR controller 70. The AR controller 70 may be a computing system that communicates through the data communication network 50 with the ticket server 90 and the AR devices 200 to coordinate the generation and rendering of virtual images to one or more players using the AR devices 200. The AR controller 70 may be implemented within or separately from the central controller 40.

In some embodiments, the AR controller 70 may coordinate the generation and display of the virtual images of the same virtual object to more than one player by more than one AR device 200. As described in more detail below, this may enable multiple players to interact with the same virtual object together in real time. This feature can be used to provide a shared multiplayer experience to multiple players at the same time.

Moreover, in some embodiments, the AR controller 70 may coordinate the generation and display of the same virtual object to players at different physical locations, as will be described in more detail below.

Referring to FIGS. 2A to 2D, the AR device 200 may be implemented in a number of different ways. For example, referring to FIG. 2A, in some embodiments, an AR device 200A may be implemented as a 3D headset including a pair of semitransparent lenses 212 on which images of virtual objects may be displayed. Different stereoscopic images may be displayed on the lenses 212 to create an appearance of depth, while the semitransparent nature of the lenses 212 allows the user to see both the real world as well as the 3D image rendered on the lenses 212. The AR device 200A may be implemented, for example, using a Hololens™ from Microsoft Corporation. The Microsoft Hololens includes a plurality of cameras 234 and other sensors 211 that the device uses to build a 3D model of the space around the user. The device 200A can generate a 3D image to display to the user that takes into account the real-world objects around the user and allows the user to interact with the 3D object.

The device 200A may further include other sensors 232, such as a gyroscopic sensor, a GPS sensor, one or more accelerometers, and/or other sensors that allow the device 200A to determine its position and orientation in space. In further embodiments, the device 200A may include one or more cameras that allow the device 200A to determine its position and/or orientation in space using visual simultaneous localization and mapping (VSLAM). The device 200A may further include one or more microphones and/or speakers 235 that allow the user to interact audially with the device.

Figure 2A:
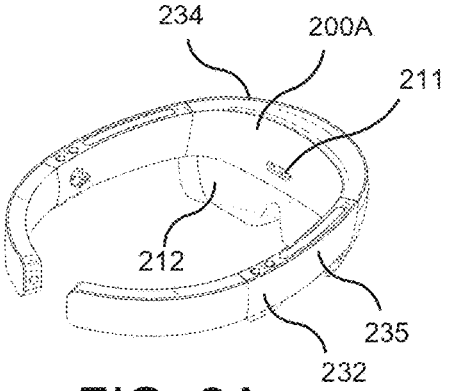
FIGS. 2A to 2D illustrate augmented reality viewing devices according to various embodiments.
Figure 2B:
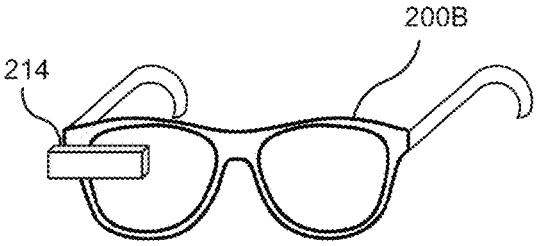

Referring to FIG. 2B, an AR device 200B may be implemented as a pair of glasses 200B including a transparent prismatic display 214 that displays an image to a single eye of the user. An example of such a device is the Google Glass device. Such a device may be capable of displaying images to the user while allowing the user to see the world around the user, and as such can be used as a mixed reality viewer.

Figure 2C:
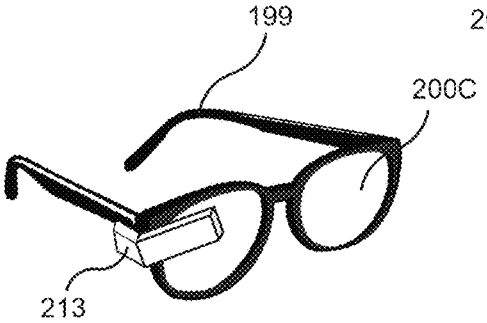

In other embodiments, referring to FIG. 2C, the AR device may be implemented using a virtual retinal display device 200C. In contrast to devices that display an image within the field of view of the user, a virtual retinal display 200C may raster scan an image directly onto the retina of the user. In some embodiments, the virtual retinal display 200C may include glasses 199 that may support and/or position virtual retinal display 200C relative to the user's eyes. In some embodiments, the virtual retinal display 200C may be configured to be removably coupled to glasses that are not provided with the virtual retinal display 200C. In such embodiments, the virtual retinal display may be used in conjunction with user supplied glasses 199 that may include lenses for correcting vision impairments. Like the device 200B, the virtual retinal display device 200C combines the displayed image with surrounding light to allow the user to see both the real world and the displayed image. However, also like the device 200B, the virtual retinal display device 200C may be incapable of displaying 3D images to the user.

Figure 2D:
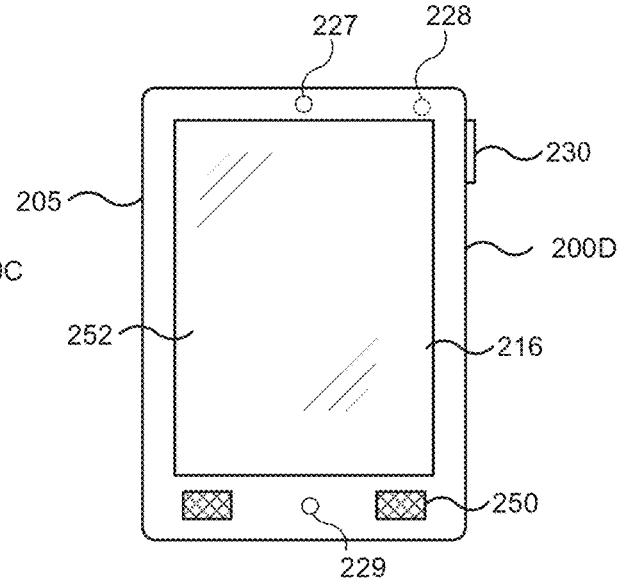

In still further embodiments, an AR device 200D, as shown in FIG. 2D, may be implemented using a mobile wireless device, such as a mobile telephone, a tablet computing device, a personal digital assistant, or the like. The device 200D may be a handheld device including a housing 205 on which a touchscreen display device 216 including a digitizer 252 is provided. An input button 230 may be provided on the housing and may act as a power or control button. A rear facing camera 227 may be provided in a front face of the housing 205. The device 200D may further include a front facing camera 228 on a rear face of the housing 205. The device 200D may include one or more speakers 250 and a microphone 229. The device 200D may provide a mixed reality display by capturing a video signal using the front facing camera 228 and displaying the video signal on the display device 216, and also displaying a rendered image of a virtual object over the captured video signal. In this manner, the user may see both a mixed image of both a real object in front of the device 200D as well as a virtual object superimposed over the real object to provide a mixed reality viewing experience.

Figure 2E:
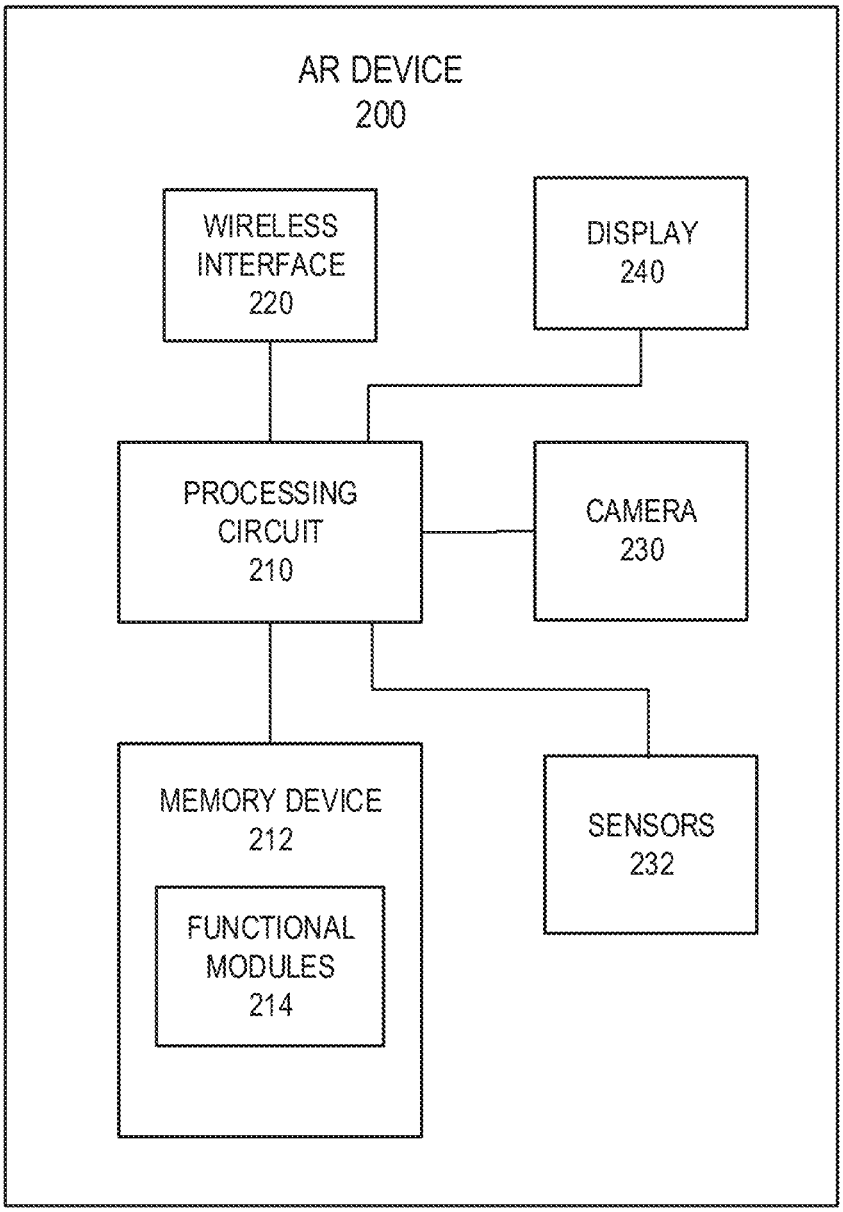
FIG. 2E is a schematic block diagram of an augmented reality device according to some embodiments.

FIG. 2E is a block diagram that illustrates various components of an AR device 200 according to some embodiments. As shown in FIG. 2E, the AR device 200 may include a processing circuit 210 that controls operations of the AR device 200. Although illustrated as a single processing circuit, multiple special purpose and/or general purpose processors and/or processor cores may be provided in the AR device 200. For example, the AR device 200 may include one or more of a video processor, a signal processor, a sound processor and/or a communication controller that performs one or more control functions within the AR device 200. The processing circuit 210 may be variously referred to as a "controller," "microcontroller," "microprocessor" or simply a "computer." The processing circuit 210 may further include one or more application-specific integrated circuits (ASICs).

Various components of the AR device 200 are illustrated in FIG. 2E as being connected to the processing circuit 210. It will be appreciated that the components may be connected to the processing circuit 210 through a system bus, a communication bus and controller, such as a USB controller and USB bus, a network interface, or any other suitable type of connection.

The AR device 200 further includes a camera 230 for generating a video signal and a display 240 for displaying AR graphics to a user as virtual images or virtual elements. The AR graphics may be displayed directly within a field of view so as to appear to be present within a scene and/or may be digitally added to a live video signal so as to appear to be present within the live video signal.

The AR device 200 further includes a memory device 212 that stores one or more functional modules 214 for performing the operations described herein.

The memory device 212 may store program code and instructions, executable by the processing circuit 210, to control the AR device 200. The memory device 210 may include random access memory (RAM), which can include volatile and/or non-volatile RAM (NVRAM) and other forms as commonly understood in the gaming industry. In some embodiments, the memory device 212 may include read only memory (ROM). In some embodiments, the memory device 212 may include flash memory and/or EEPROM (electrically erasable programmable read only memory). Any other suitable magnetic, optical and/or semiconductor memory may operate in conjunction with the gaming device disclosed herein.

The AR device 200 may include a wireless interface 220 that enables the AR device 200 to communicate with remote devices, such as EGMs 100 and/or an AR controller 70 over a wired and/or wireless communication network, such as a local area network (LAN), wide area network (WAN), cellular communication network, wireless LAN (Wifi), Bluetooth, near-field communications (NFC) or other data communication network. The wireless interface 220 may include multiple radios to support multiple types of simultaneous connections. For example, the wireless interface may include both a Wifi radio transceiver and a Bluetooth radio transceiver.

Electronic Gaming Machines

Figure 3A:
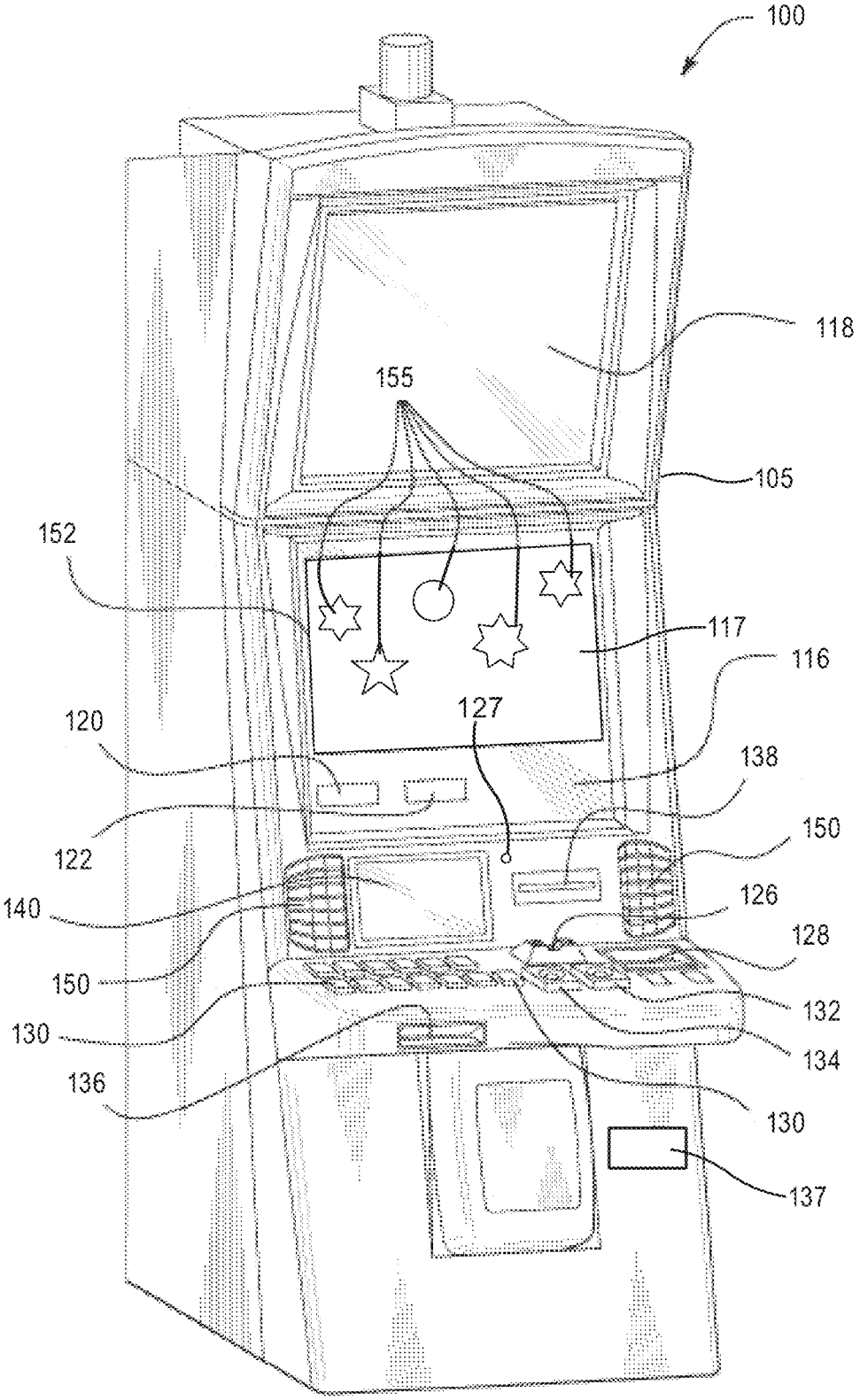
FIG. 3A is a perspective view of a gaming device that can be configured according to some embodiments.
Figure 3B:
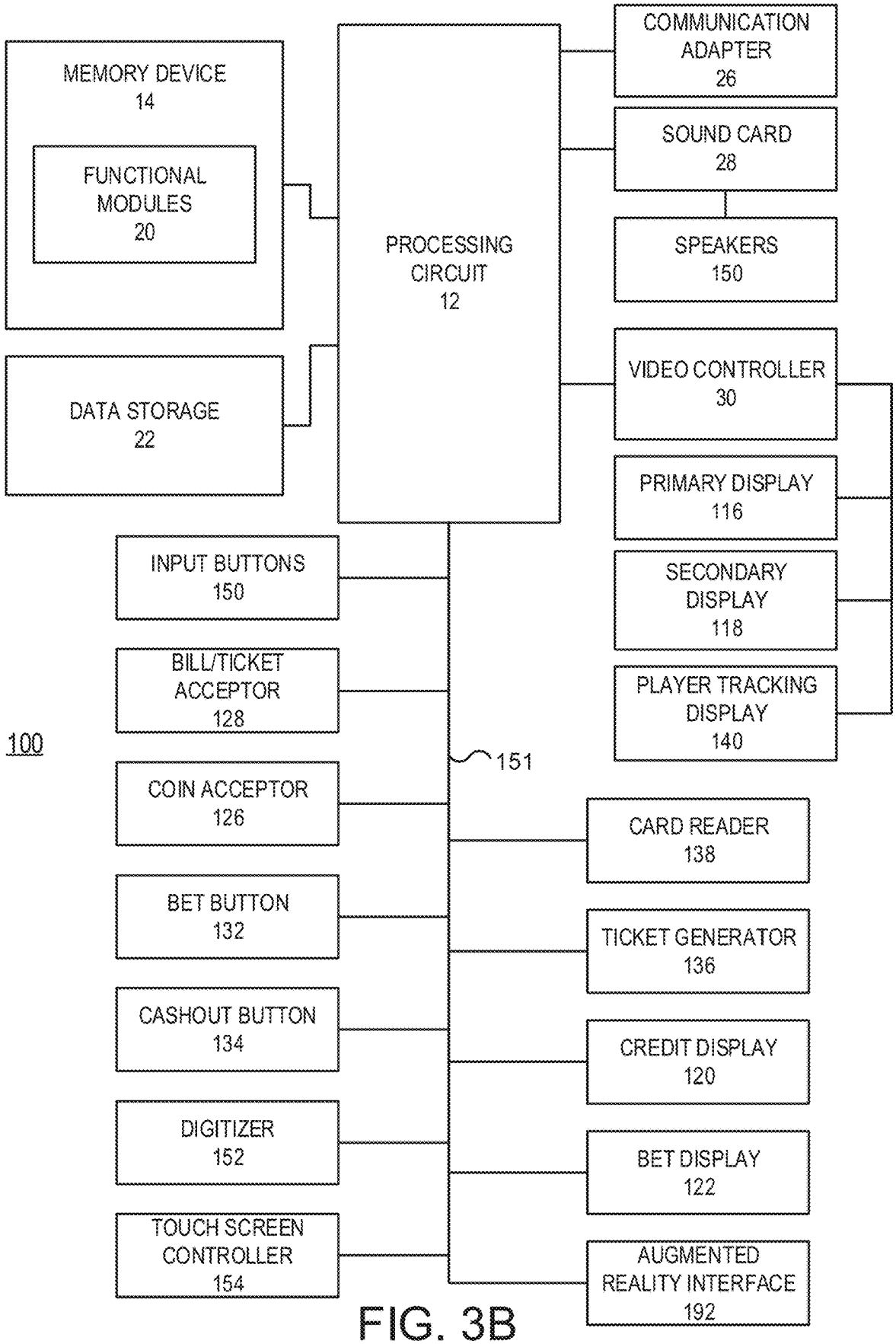
FIG. 3B is a schematic block diagram illustrating an electronic configuration for a gaming device according to some embodiments.
Figure 3C:
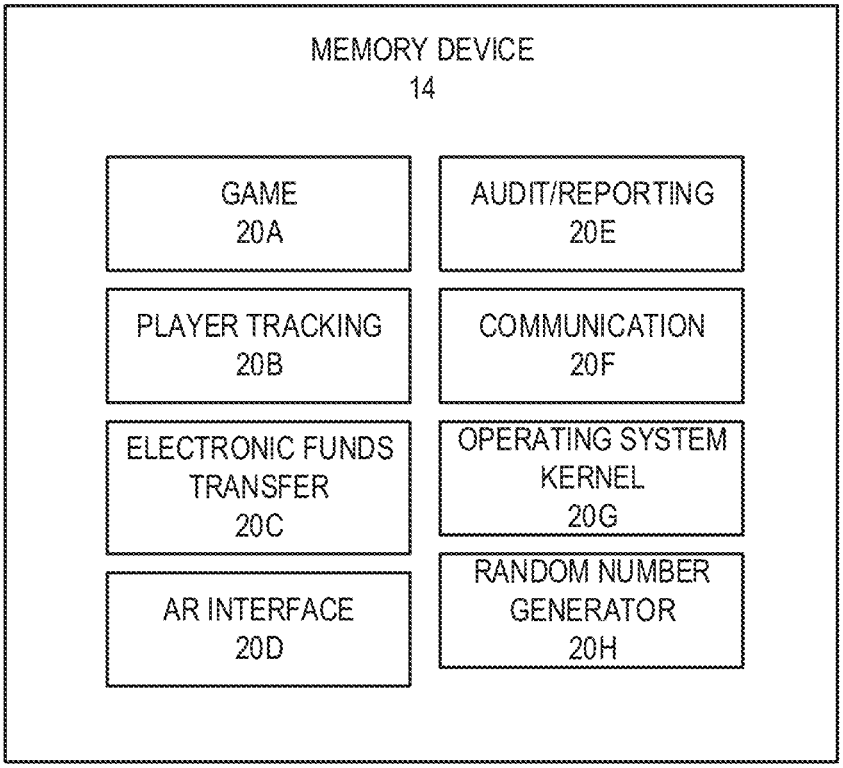
FIG. 3C is a schematic block diagram that illustrates various functional modules of a gaming device according to some embodiments.

Embodiments herein may include different types of gaming devices. One example of a gaming device includes an electronic gaming machine (EGM) 100 that can interact with mixed reality viewers according to various embodiments is illustrated in FIGS. 3A, 3B, and 3C in which FIG. 3A is a perspective view of an EGM 100 illustrating various physical features of the device, FIG. 3B is a functional block diagram that schematically illustrates an electronic relationship of various elements of the EGM 100, and FIG. 3C illustrates various functional modules that can be stored in a memory device of the EGM 100. The embodiments shown in FIGS. 3A to 3C are provided as examples for illustrative purposes only. It will be appreciated that EGMs may come in many different shapes, sizes, layouts, form factors, and configurations, and with varying numbers and types of input and output devices, and that embodiments of the inventive concepts are not limited to the particular EGM structures described herein.

EGMs 100 typically include a number of standard features, many of which are illustrated in FIGS. 3A and 3B. For example, referring to FIG. 3A, an EGM 100 may include a support structure, housing or cabinet 105 which provides support for a plurality of displays, inputs, outputs, controls and other features that enable a player to interact with the EGM 100.

The EGM 100 illustrated in FIG. 3A includes a number of display devices, including a primary display device 116 located in a central portion of the cabinet 105 and a secondary display device 118 located in an upper portion of the cabinet 105. A plurality of game components 155 are displayed on a display screen 117 of the primary display device 116. It will be appreciated that one or more of the display devices 116, 118 may be omitted, or that the display devices 116, 118 may be combined into a single display device. The EGM 100 may further include a player tracking display 140, a credit display 120, and a bet display 122. The credit display 120 displays a player's current number of credits, cash, account balance or the equivalent. The bet display 122 displays a player's amount wagered. Locations of these displays are merely illustrative as any of these displays may be located anywhere on the EGM 100.

The player tracking display 140 may be used to display a service window that allows the player to interact with, for example, their player loyalty account to obtain features, bonuses, comps, etc. In other embodiments, additional display screens may be provided beyond those illustrated in FIG. 3A. In some embodiments, one or more of the player tracking display 140, the credit display 120 and the bet display 122 may be displayed in one or more portions of one or more other displays that display other game related visual content. For example, one or more of the player tracking display 140, the credit display 120 and the bet display 122 may be displayed in a picture in a picture on one or more displays.

The EGM 100 may further include a number of input devices 130 that allow a player to provide various inputs to the EGM 100, either before, during or after a game has been played. For example, the EGM 100 may include input devices 130 that are a plurality of input buttons 130 that allow the player to select options before, during or after game play. The EGM may further include a game play initiation button 132 and a cashout button 134. The cashout button 134 is utilized to receive a cash payment or any other suitable form of payment corresponding to a quantity of remaining credits of a credit display.

In some embodiments, one or more input devices of the EGM 100 are one or more game play activation devices that are each used to initiate a play of a game on the EGM 100 or a sequence of events associated with the EGM 100 following appropriate funding of the EGM 100. The example EGM 100 illustrated in FIGS. 3A and 3B includes a game play activation device in the form of a game play initiation button 132. It should be appreciated that, in other embodiments, the EGM 100 begins game play automatically upon appropriate funding rather than upon utilization of the game play activation device.

In some embodiments, one or more input devices 130 of the EGM 100 are one or more wagering or betting devices. One such wagering or betting device includes a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In some embodiments, one or more of the display screens may a touch-sensitive display that includes a digitizer 152 and a touchscreen controller 154 (FIG. 3B). The player may interact with the EGM 100 by touching virtual buttons on one or more of the display devices 116, 118, 140. Accordingly, any of the above described input devices, such as the input buttons 130, the game play initiation button 132 and/or the cashout button 134 may be provided as virtual buttons on one or more of the display devices 116, 118, 140.

Referring briefly to FIG. 3B, operation of the primary display device 116, the secondary display device 118 and the player tracking display 140 may be controlled by a video controller 30 that receives video data from a processing circuit 12 or directly from a memory device 14 and displays the video data on the display screen. The credit display 120 and the bet display 122 are typically implemented as simple LCD or LED displays that display a number of credits available for wagering and a number of credits being wagered on a particular game. Accordingly, the credit display 120 and the bet display 122 may be driven directly by the processing circuit 12. In some embodiments however, the credit display 120 and/or the bet display 122 may be driven by the video controller 30.

Referring again to FIG. 3A, the display devices 116, 118, 140 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 116, 118, 140 may include a touch-screen with an associated touch-screen controller 154 and digitizer 152. The display devices 116, 118, 140 may be of any suitable size, shape, and/or configuration. The display devices 116, 118, 140 may include flat or curved display surfaces.

The display devices 116, 118, 140 and video controller 30 of the EGM 100 are generally configured to display one or more game and/or non-game images, symbols, and indicia. In certain embodiments, the display devices 116, 118, 140 of the EGM 100 are configured to display any suitable visual representation or exhibition of the movement of objects; dynamic lighting; video images; images of people, characters, places, things, and faces of cards; and the like. In certain embodiments, the display devices 116, 118, 140 of the EGM 100 are configured to display one or more virtual reels, one or more virtual wheels, and/or one or more virtual dice. In other embodiments, certain of the displayed images, symbols, and indicia are in mechanical form. That is, in these embodiments, the display device 116, 118, 140 includes any electromechanical device, such as one or more rotatable wheels, one or more reels, and/or one or more dice, configured to display at least one or a plurality of game or other suitable images, symbols, or indicia.

The EGM 100 also includes various features that enable a player to deposit credits in the EGM 100 and withdraw credits from the EGM 100, such as in the form of a payout of winnings, credits, etc. For example, the EGM 100 may include a ticket dispenser 136, a bill/ticket acceptor 128, and a coin acceptor 126 that allows the player to deposit coins into the EGM 100.

As illustrated in FIG. 3A, the EGM 100 may also include a currency dispenser 137 that may include a note dispenser configured to dispense paper currency and/or a coin generator configured to dispense coins or tokens in a coin payout tray.

The EGM 100 may further include one or more speakers 150 controlled by one or more sound cards 28 (FIG. 3B). The EGM 100 illustrated in FIG. 3A includes a pair of speakers 150. In other embodiments, additional speakers, such as surround sound speakers, may be provided within or on the cabinet 105. Moreover, the EGM 100 may include built-in seating with integrated headrest speakers.

In various embodiments, the EGM 100 may generate dynamic sounds coupled with attractive multimedia images displayed on one or more of the display devices 116, 118, 140 to provide an audio-visual representation or to otherwise display full-motion video with sound to attract players to the EGM 100 and/or to engage the player during gameplay. In certain embodiments, the EGM 100 may display a sequence of audio and/or visual attraction messages during idle periods to attract potential players to the EGM 100. The videos may be customized to provide any appropriate information.

The EGM 100 may further include a card reader 138 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processing circuit determines the amount of funds entered and displays the corresponding amount on the credit or other suitable display as described above.

In some embodiments, the EGM 100 may include an electronic payout device or module configured to fund an electronically recordable identification card or smart card or a bank or other account via an electronic funds transfer to or from the EGM 100.

FIG. 3B is a block diagram that illustrates logical and functional relationships between various components of an EGM 100. As shown in FIG. 3B, the EGM 100 may include a processing circuit 12 that controls operations of the EGM 100. Although illustrated as a single processing circuit, multiple special purpose and/or general purpose processors and/or processor cores may be provided in the EGM 100. For example, the EGM 100 may include one or more of a video processor, a signal processor, a sound processor and/or a communication controller that performs one or more control functions within the EGM 100. The processing circuit 12 may be variously referred to as a "controller," "microcontroller," "microprocessor" or simply a "computer." The processor may further include one or more application-specific integrated circuits (ASICs).

Various components of the EGM 100 are illustrated in FIG. 3B as being connected to the processing circuit 12. It will be appreciated that the components may be connected to the processing circuit 12 through a system bus, a communication bus and controller, such as a USB controller and USB bus, a network interface, or any other suitable type of connection.

The EGM 100 further includes a memory device 14 that stores one or more functional modules 20. Various functional modules 20 of the EGM 100 will be described in more detail below in connection with FIG. 3D.

The memory device 14 may store program code and instructions, executable by the processing circuit 12, to control the EGM 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The EGM 100 may further include a data storage device 22, such as a hard disk drive or flash memory. The data storage 22 may store program data, player data, audit trail data or any other type of data. The data storage 22 may include a detachable or removable memory device, including, but not limited to, a suitable cartridge, disk, CD ROM, DVD or USB memory device.

The EGM 100 may include a communication adapter 26 that enables the EGM 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the EGM 100 to communicate, for example, with a mobile communication device operated by a player.

The EGM 100 may include one or more internal or external communication ports that enable the processing circuit 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processing circuit through a universal serial bus (USB) hub (not shown) connected to the processing circuit 12.

In some embodiments, the EGM 100 may include a sensor, such as a camera in communication with the processing circuit 12 (and possibly controlled by the processing circuit 12) that is selectively positioned to acquire an image of a player actively using the EGM 100 and/or the surrounding area of the EGM 100. In one embodiment, the camera may be configured to selectively acquire still or moving (e.g., video) images and may be configured to acquire the images in either an analog, digital or other suitable format. The display devices 116, 118, 140 may be configured to display the image acquired by the camera as well as display the visible manifestation of the game in split screen or picture-in-picture fashion. For example, the camera may acquire an image of the player and the processing circuit 12 may incorporate that image into the primary and/or secondary game as a game image, symbol or indicia.

Various functional modules of that may be stored in a memory device 14 of an EGM 100 are illustrated in FIG. 3C. Referring to FIG. 3C, the EGM 100 may include in the memory device 14 a game module 20A that includes program instructions and/or data for operating a hybrid wagering game as described herein. The EGM 100 may further include a player tracking module 20B, an electronic funds transfer module 20C, a wide area progressive module 20D, an audit/reporting module 20E, a communication module 20F, an operating system 20G and a random number generator 20H. The player tracking module 20B keeps track of the play of a player. The electronic funds transfer module 20C communicates with a back end server or financial institution to transfer funds to and from an account associated with the player. The AR interface module 20D interacts with an AR device 200 as described in more detail below. The communication module 20F enables the EGM 100 to communicate with remote servers and other EGMs using various secure communication interfaces. The operating system kernel 20G controls the overall operation of the EGM 100, including the loading and operation of other modules. The random number generator 20H generates random or pseudorandom numbers for use in the operation of the hybrid games described herein.

In some embodiments, an EGM 100 comprises a personal device, such as a desktop computer, a laptop computer, a mobile device, a tablet computer or computing device, a personal digital assistant (PDA), or other portable computing devices. In some embodiments, the EGM 100 may be operable over a wireless network, such as part of a wireless gaming system. In such embodiments, the gaming machine may be a hand-held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission.

Figure 3D:
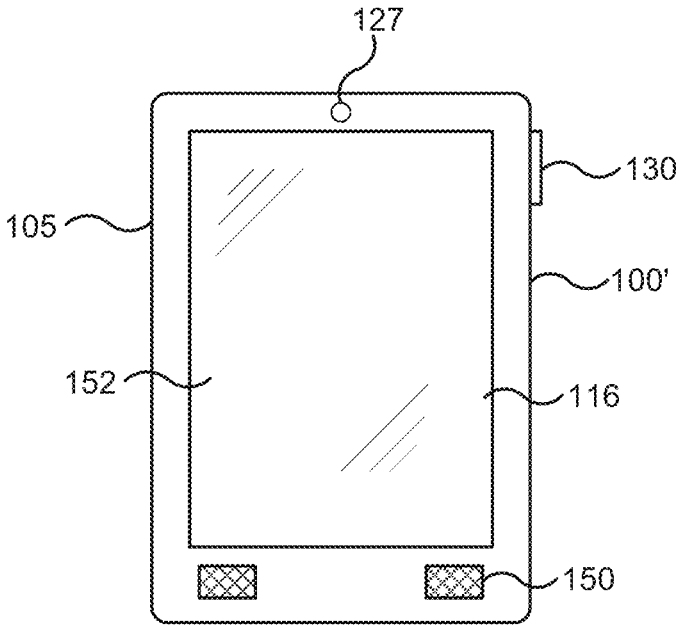
FIG. 3D is perspective view of a gaming device that can be configured according to some embodiments.

For example, referring to FIG. 3D, an EGM 100' may be implemented as a handheld device including a compact housing 105 on which is mounted a touchscreen display device 116 including a digitizer 152. An input button 130 may be provided on the housing and may act as a power or control button. A camera 127 may be provided in a front face of the housing 105. The housing 105 may include one or more speakers 150. In the EGM 100', various input buttons described above, such as the cashout button, gameplay activation button, etc., may be implemented as soft buttons on the touchscreen display device 116. Moreover, the EGM 100' may omit certain features, such as a bill acceptor, a ticket generator, a coin acceptor or dispenser, a card reader, secondary displays, a bet display, a credit display, etc. Credits can be deposited in or transferred from the EGM 100' electronically.

Figure 3E:
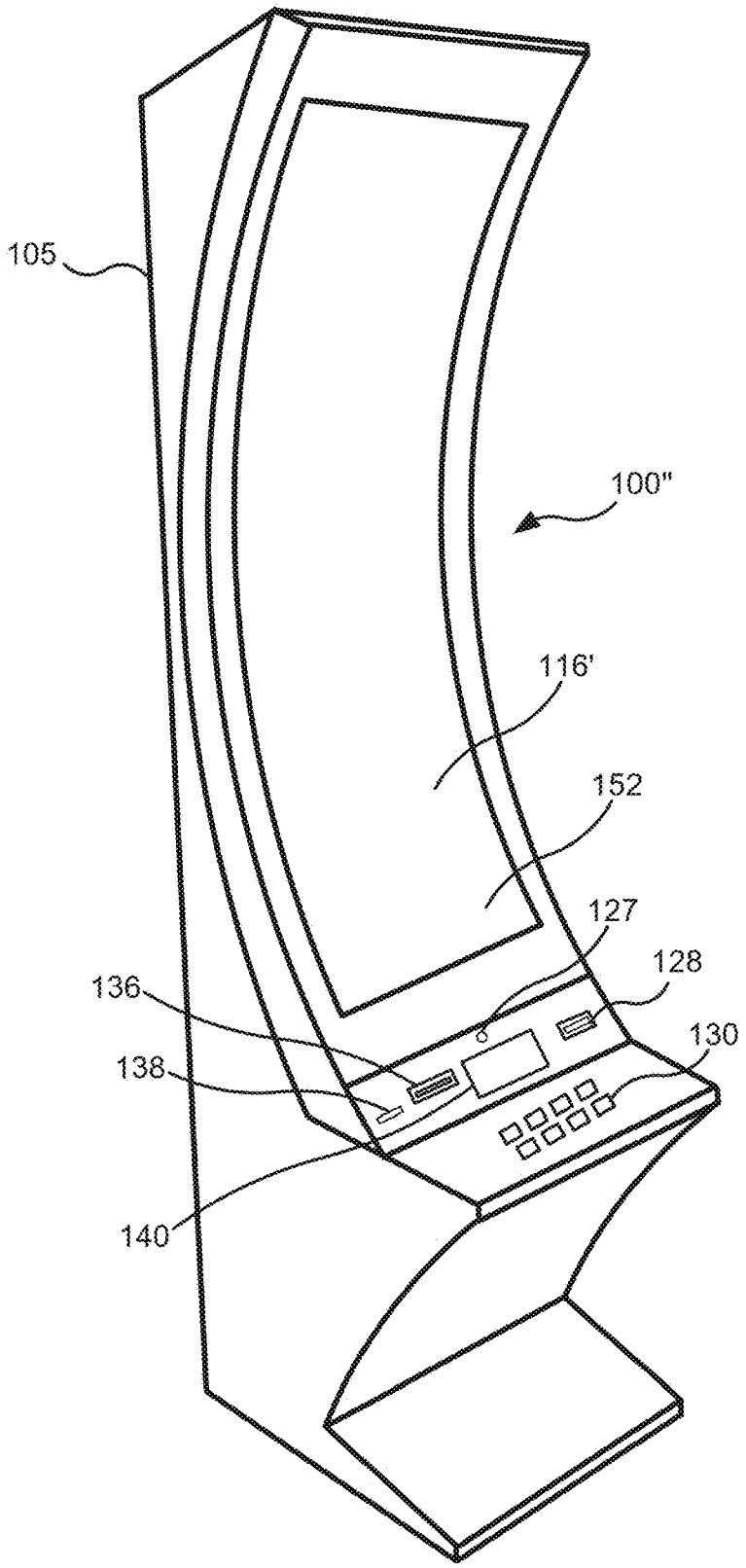
FIG. 3E is a perspective view of a gaming device according to further embodiments.

FIG. 3E illustrates a standalone EGM 100" having a different form factor from the EGM 100 illustrated in FIG. 3A. In particular, the EGM 100" is characterized by having a large, high aspect ratio, curved primary display device 116' provided in the housing 105, with no secondary display device. The primary display device 116' may include a digitizer 152 to allow touchscreen interaction with the primary display device 116'. The EGM 100" may further include a player tracking display 140, a plurality of input buttons 130, a bill/ticket acceptor 128, a card reader 138, and a ticket generator 136. The EGM 100" may further include one or more cameras 127 to enable facial recognition and/or motion tracking.

Although illustrated as EGMs, similar functions and/or operations as described herein may include wagering stations that may include electronic game tables, conventional game tables including those involving cards, dice and/or roulette, and/or other wagering stations such as sports book stations, video poker games, skill-based games, virtual casino-style table games, or other casino or non-casino style games. Further, EGMs according to embodiments herein may be implemented using mobile terminals, such as smart phones, tablets, and/or laptop computers, among others.

Augmented Reality Applications

As provided in FIG. 1-3E, as more and more AR viewing devices 200 become available to players, manufacturers of gaming devices may desire to incorporate support for such devices into their machines. By providing AR display content in the context of a wagering ticket, manufacturers may increase the flexibility of the prizes and/or types thereof that may be awarded, all while providing additional incentive for the player to retain the wagering ticket for a longer period of time based on the potential for increased value, different prizes and/or the increased entertainment value.

Some embodiments of the inventive concepts provide a communication interface by which a ticket server 90 can integrate AR device support with a relatively low amount of customization. According to some embodiments, a ticket server 90 may communicate to an AR device 200 where on or near a wagering ticket that is issued by or based on instruction from the ticket server 90. The animation can be displayed responsive to reading data code on the wagering ticket and the actual processing to determine exactly where, when and how to display the animation may be performed by the AR device 200 and/or an AR controller 70.

In some embodiments, an AR device 200 may be used to display game elements, game components, game information, game animation and/or other elements on and/or adjacent the wagering ticket to a player while the player is looking at the wagering ticket. In some embodiments, an AR device 200 may be configured to display a two-dimensional or three-dimensional animation when the player is looking at the wagering ticket and/or when the wagering ticket is in the field of view of the payer and/or the AR device 200. Such animations, particularly when rendered in three dimensions, may appear to the player to be part of a real scene and thus can enhance the game play experience for the player.

In some embodiments, the AR device 200 may be used to display game elements, game components, game information, game animation and/or other elements at a location other than adjacent or on the wagering ticket in response to reading the data code on the wagering ticket. For example, once the data code on the wagering ticket has been read, the display of game elements, game components, game information, game animation and/or other elements may be provided in other areas around the player, such as, for example, in a casino.

Reference is now made to FIGS. 4A-4F, which are front schematic views of a wagering ticket in accordance with some embodiments herein. Briefly referring to FIG. 4A, a wagering ticket 400 may be a printed ticket that may printed by any of a variety of gaming devices. For example, gaming devices may include EGMs 100 that are configured to print a ticket in response to receiving a cashout input from a player. In some embodiments, a gaming device may be a kiosk that is configured to print a wagering ticket that represents a wager place on the outcome of an event, such as, for example, a sporting event. Some embodiments provide that the ticket may include a lottery ticket and the gaming device may include a lottery terminal that may include a point-of-sale lottery terminal and/or a manned lottery terminal.

The wagering ticket 400 may include a game description field 402 that includes information corresponding to the wagering game and/or the game provider, among others. For example, the game description field 402 may include information corresponding to a wagering event and/or an effective date.

Some embodiments provide that the wagering ticket 400 includes a redemption instructions field 404 that includes information corresponding to redeeming the wagering ticket 400. Additionally, some embodiments provide that the wagering ticket 400 includes a code data portion 410 that includes a printed code that may be read using any of a variety of image capture devices, such as a camera 230 on an AR device 200. Some embodiments provide that the code data portion 410 is a bar code that includes data content that is readable across one or more dimensions. For example, some embodiments provide that the code data portion 410 is a one-dimensional bar code. Some embodiments herein may provide that the code data portion 410 may include other types of optically readable codes including two-dimensional codes such as "QR" codes and/or two-dimensional matrix barcodes.

Figure 4A:
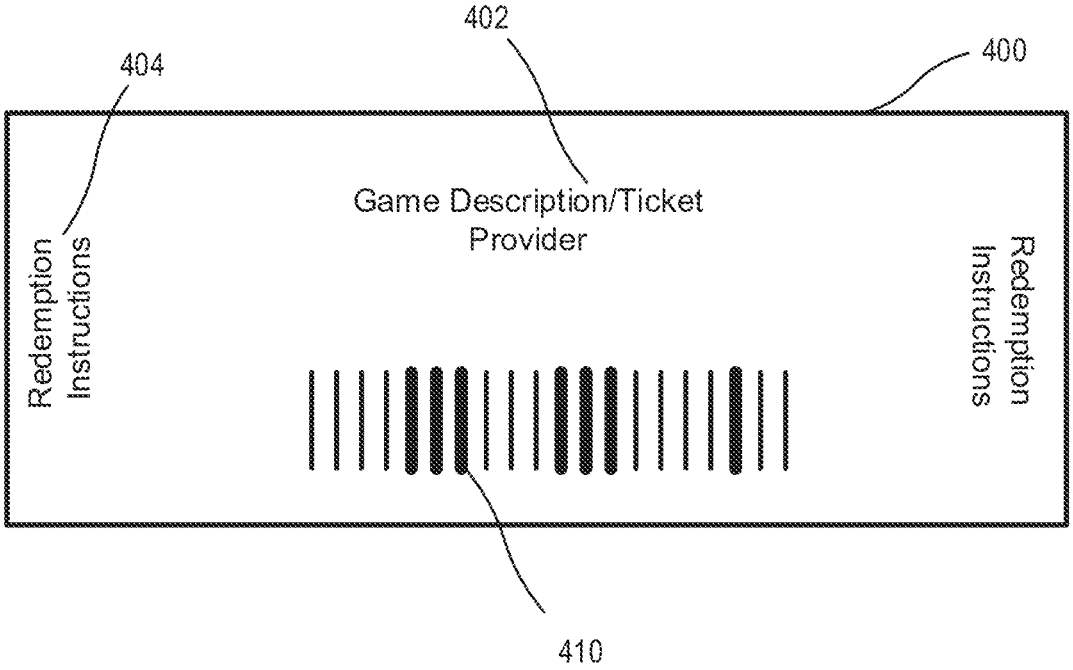
FIGS. 4A-4F are front schematic views of a wagering ticket in accordance with some embodiments herein.
Figure 4B:
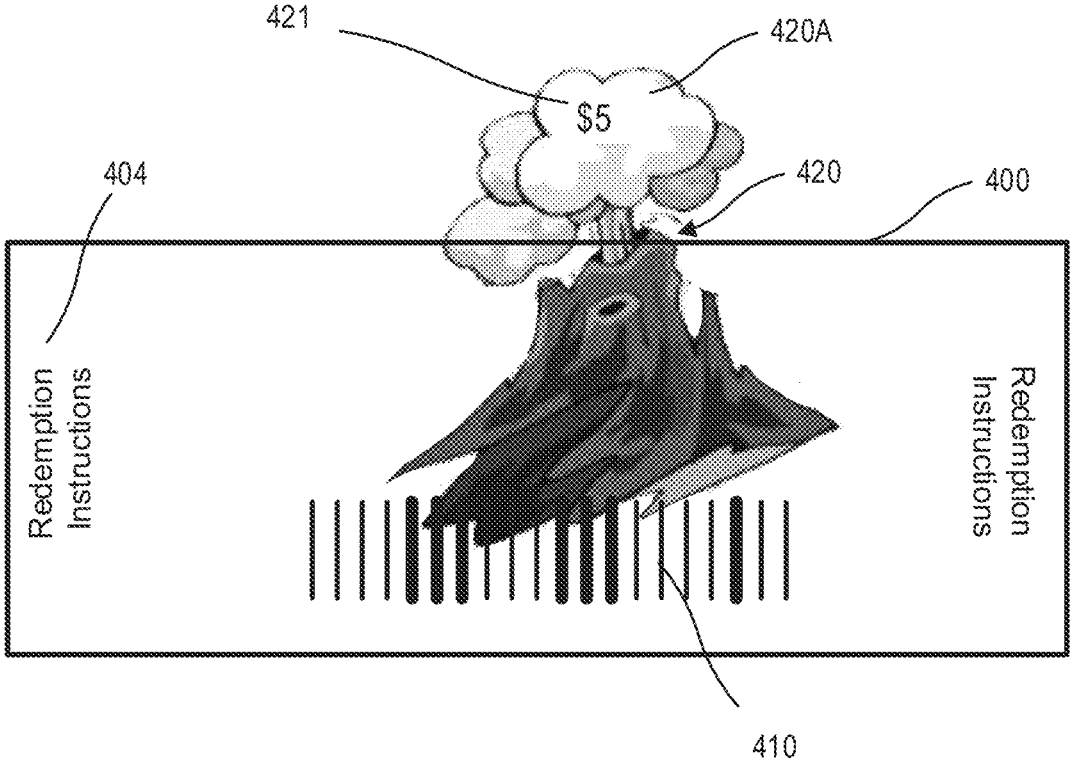

Referring to FIG. 4B, based on receiving the image data corresponding to the code data portion, an AR device 200 may be caused to display AR display content 420. The AR display content 420 may be viewable along with the wagering ticket that is viewable through the AR device. In this manner, the AR display content 420 and the wagering ticket may create a combined image that is viewable by the user. The AR display content 420 may be associated with the wagering event and/or be a display of an unrelated image and/or animation that may generate indication of an additional value that may be added to the value of the wagering ticket. For example, the AR display content 420-A of FIG. 4B includes an animation or image of a volcano that may erupt randomly generated prize images 421 that may identify additional value that may be added to the value of the wagering ticket 400.

Figure 4C:
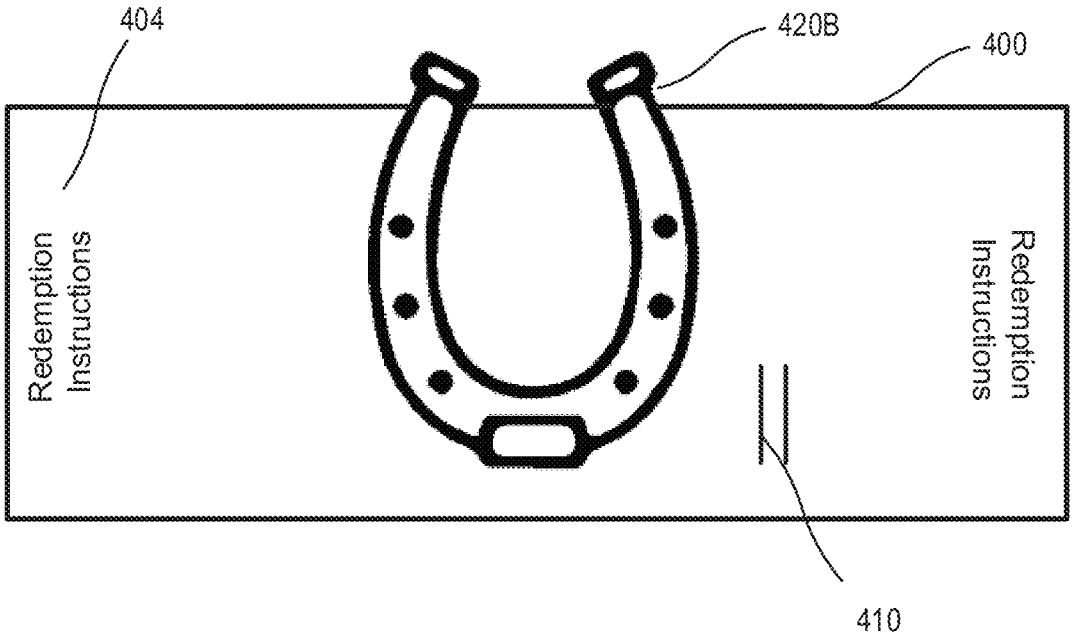
Figure 4D:
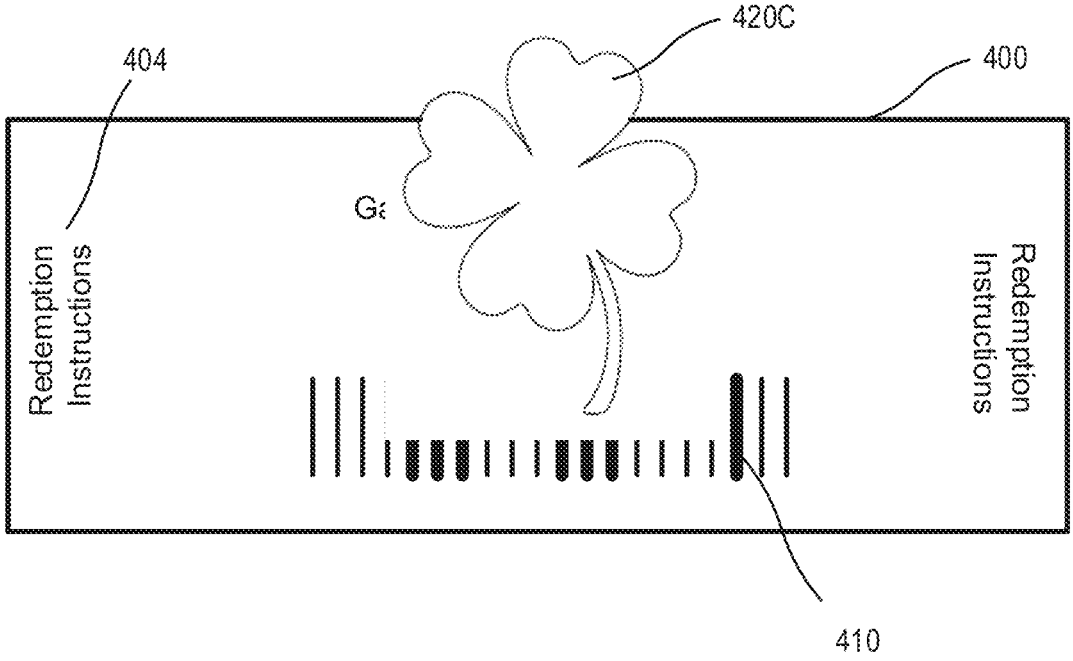

Briefly referring to FIGS. 4C and 4D, the AR display content 420 may include one or more lucky images that the player may associate with luck in the current and/or future wagering events. For example, the AR display content 420B may include a horseshoe and the AR display content 420C may include a four-leaf clover. Such images are non-limiting examples as many different lucky symbols may be included in the AR display content 420.

Figure 4E:
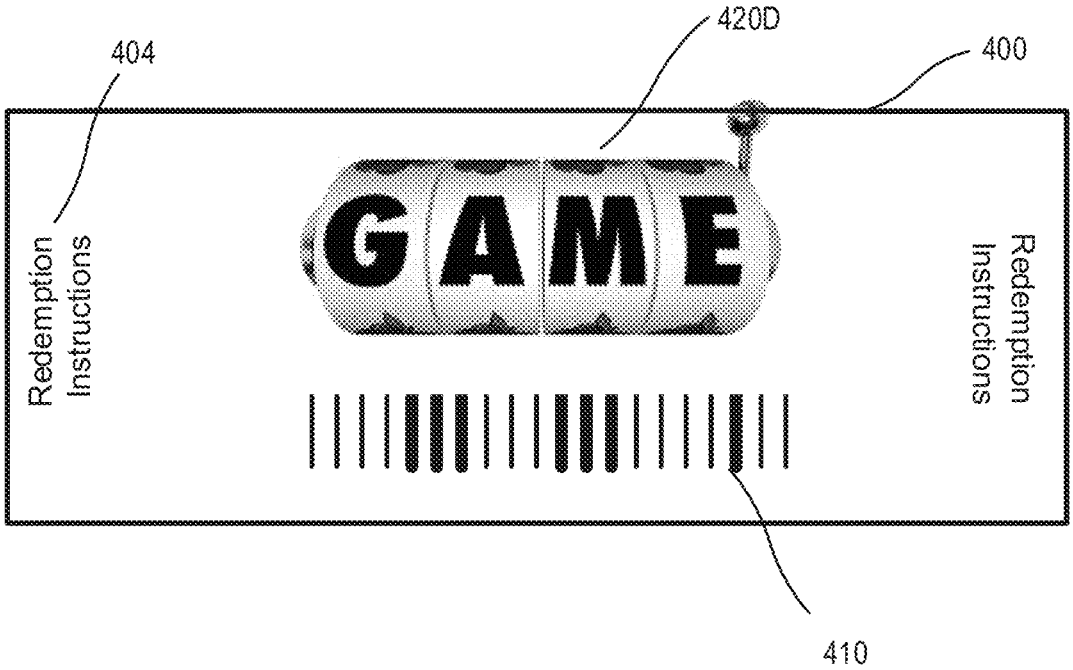
Figure 4F:
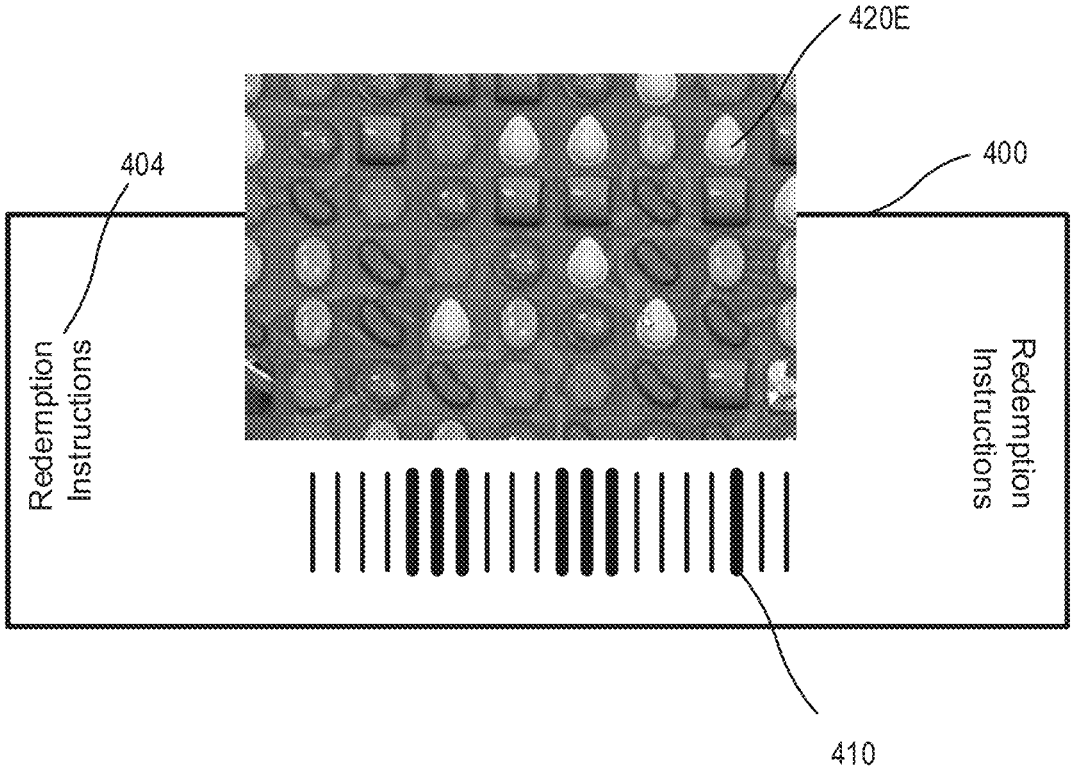

Briefly referring to FIGS. 4E and 4F, the AR display content 420 may include games that the player may play to try to earn additional value to be associated with the wagering ticket. For example, AR display content 420D may include an image and/or animation of a reel or other type of wagering device that the player can play to earn additional value and/or prizes that may be associated with the wagering ticket. In some embodiments, the AR display content 420E may include a mini-game of a game that is may be a non-wagering game, such as an element matching or grouping game. Other types of games may be included in the AR display content 420 such as, for example, a racing game, a target shooting game, and/or a maze game, among others.

In some embodiments, a wagering ticket may correspond to a wagering event that is a sporting or other competitive event. For example, reference is now made to FIGS. 5A-5D, which are front schematic views of a wagering ticket in accordance with some embodiments herein. Similar to FIGS. 4A to 4F, the wagering ticket 500 may include a game description field 502 that includes information corresponding to the wagering game and/or the game provider. among others. For example, the game description field 502 may include information corresponding to a wagering event such as a sports team bet wagering that Team A will win over team B.

Figure 5A:
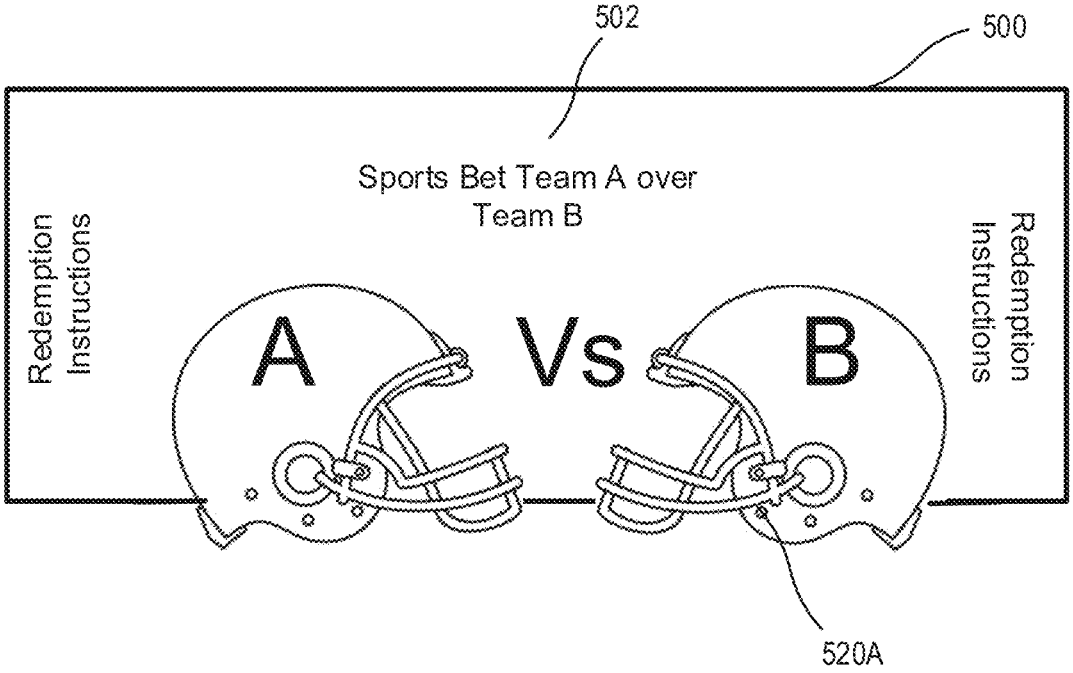
FIGS. 5A-5D are front schematic views of a wagering ticket in accordance with some embodiments herein.

Some embodiments provide that the wagering ticket 500 includes a redemption instructions field 504 that includes information corresponding to redeeming the wagering ticket 500. Additionally, the wagering ticket 500 includes a code data portion that includes a printed code. As illustrated, the printed code data portion may be obscured by the AR display content 520A. In the present example, the FIG. 5A illustrates a wagering ticket 500 corresponding to a wagering event between two sports teams. The AR display content 520A includes images and/or animations that correspond to pre-game activities, including logos, player images, mascots and/or other pre-game activities.

Figure 5B:
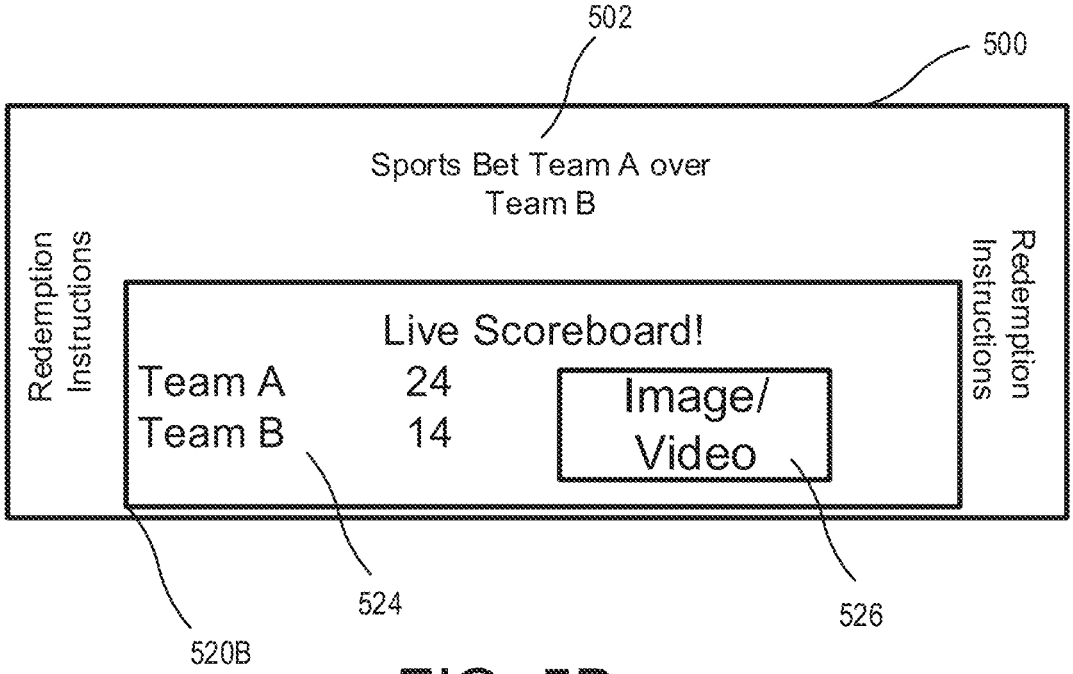
Figure 5C:
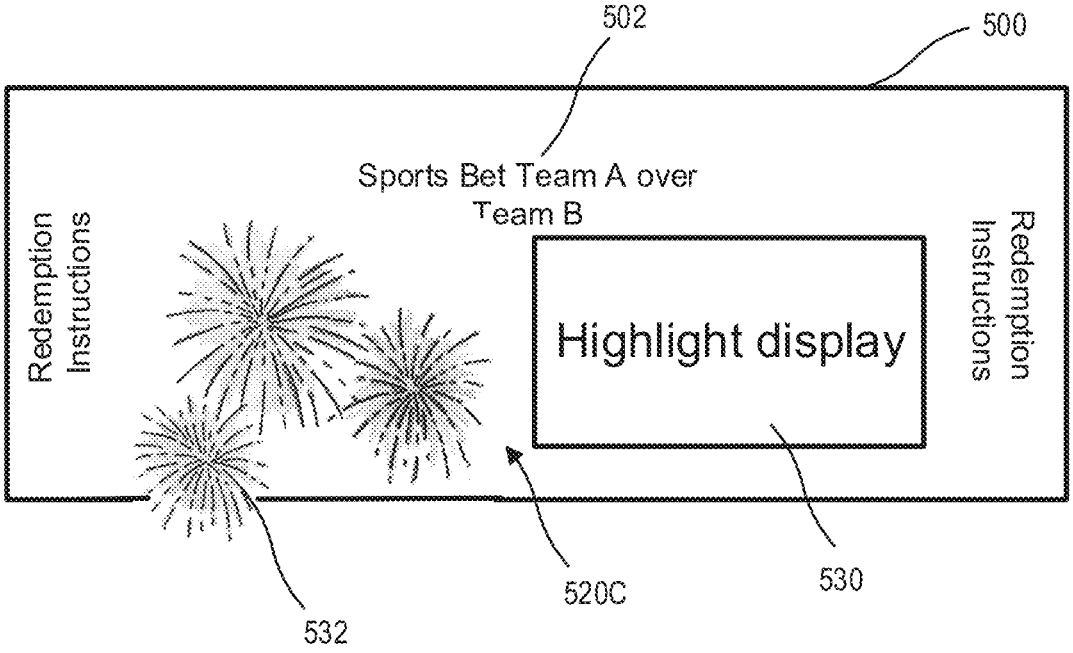

Referring to FIG. 5B, once the wagering event has begun, the AR display content 520B may include content that corresponds to the state of the event and may be updated as the state of the wagering event changes. For example, the AR display content 520B may include a live scoreboard 524 that provides scores and/or the progress of the wagering event. The progress of the wagering event may include the amount of time left in the event and/or in a given time phase of the event, such as which period or quarter the wagering event has completed. Additionally, the AR display content 520B may include image and/or video content 526 that correspond to the wagering event. In some embodiments, the images and/or video content 526 may be replays of significant plays in the wagering event.

Some embodiments provide that the AR display content 520 may correspond to post event content. For example, reference is made to FIG. 5C, which illustrates the wagering ticket 500 and AR display content 520C that includes celebratory animations 532 responsive to the wagering ticket representing a winning wager for the player. In some embodiments, the AR display content 520C may include a highlight display 530 that includes highlights of the wagering event and/or other post-game content.

Figure 5D:
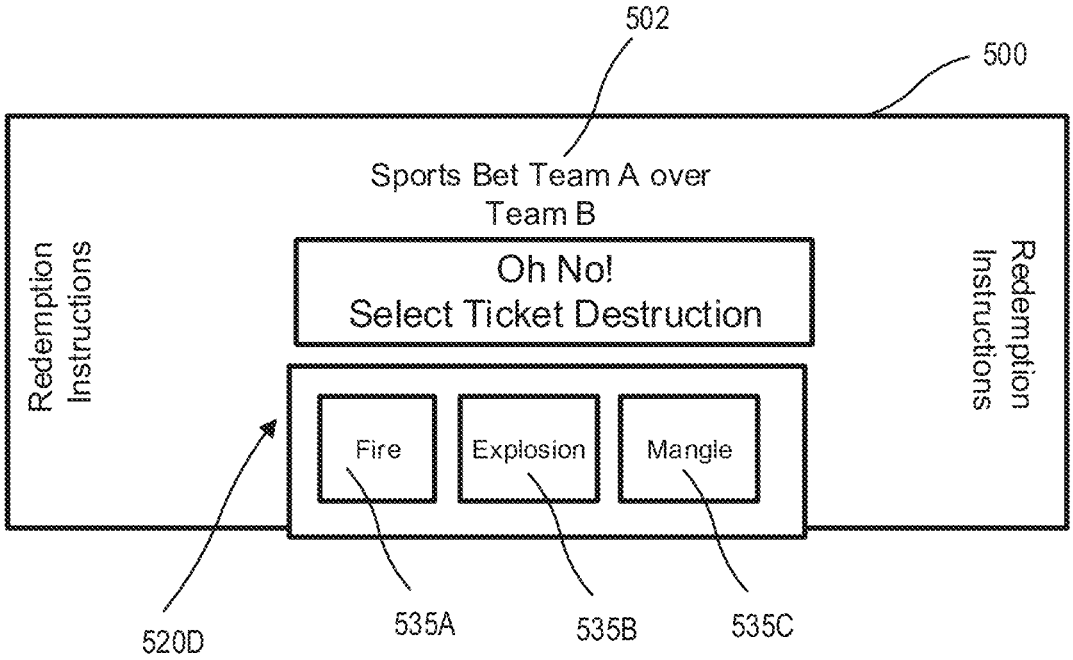

Reference is now made to FIG. 5D, which illustrates a wagering ticket 500 and AR display content 520D that includes consoling content based on the wagering ticket 500 representing a losing wager for the player. In some embodiments, the AR display content 520D may include an option for a virtual destruction of the wagering ticket 500. For example, a player with a wagering ticket 500 that corresponds to a losing wager may select the manner in which the wagering ticket 500 is destroyed such as by virtual fire 535A, virtual explosion 535B or virtual mangling of the wagering ticket 500. Some embodiments provide that the post game AR display content 520C, 520D may be repeated for the player every time they look at the wagering ticket 500 after the wagering event. In such embodiments, the player may decide to hold the wagering ticket 500 longer before redemption, which provides gaming device operators more opportunity to incentivize the player to continue to play via the same or another gaming device.

A wagering ticket according to some embodiments may include a multi-stage wagering ticket that may include multiple opportunities to win an award that may correspond to the AR display content at each of the stages. For example, brief reference is now made to FIGS. 6A-6D, which are front schematic views of a wagering ticket in accordance with some embodiments herein. As illustrated, the wagering ticket 600 may include features as discussed above regarding FIGS. 4A-4F, such as a game description field, a redemption instructions field, and a code data portion, however, additional illustration and discussion thereof may be omitted to avoid duplicative description.

Figure 6A:
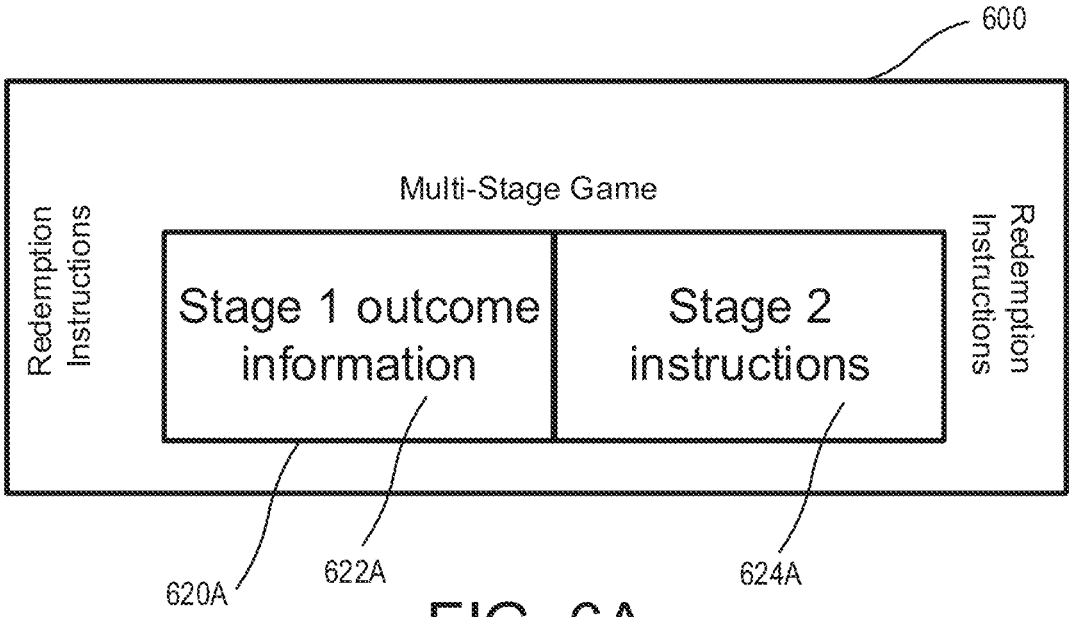
FIGS. 6A-6D are front schematic views of a wagering ticket in accordance with some embodiments herein.

Referring to FIG. 6A, the multi-stage wagering ticket 600 includes an AR display content 620A that corresponds to a first stage of the multi-stage game. The AR display content 620A may include content that corresponds to the current stage virtual content 622A in the multi-stage game and/or future stage virtual content 624A in the multi-stage game that is associated with the wagering ticket 600. For example, current stage virtual content 622A may include text, images and/or animations that include stage 1 outcome information corresponding to a status and/or an outcome of the first stage of the multi-stage game. The AR display content 620A may also include future stage virtual content 624A that may include stage 2 instructions corresponding to a next stage (e.g., stage 2) of the multi-stage game. As illustrated, the current stage virtual content 622A and the future stage virtual content 624A may be displayed to the player at the same time. However, in some other embodiments, the current stage virtual content 622A and the future stage virtual content 624A may be displayed individually. For example, the current stage virtual content 622A may be displayed first and the future stage virtual content 624A may be displayed subsequently.

In some embodiments, the multiple stages of the multi-stage game may correspond to different locations for determining the outcome of the given stage. The future stage virtual content 624A may include text, images, and/or animations that provide the player with information regarding a next location for the next stage. For example, some embodiments provide that the future stage virtual content 624A identifies another business that the player visits to determine the outcome of the next stage of the multi-stage game. In such embodiments, the future stage virtual content 624A may be a logo and/or name of the business and may include an address and/or a link to directions for getting to that business. Some embodiments provide that the future stage virtual content 624A identifies another wagering ticket reader and/or dispenser within the same facility for the player to visit to determine the outcome of the next stage of the multi-stage game.

Some embodiments provide that the multiple stages of the multi-stage game may correspond to different games and/or types thereof that may be provided to player using the AR display content 620A. In such embodiments, the multiple stages may be played without being dependent on a given location. Additional value may be added to the wagering ticket 600 based on outcomes of the games.

Figure 6B:
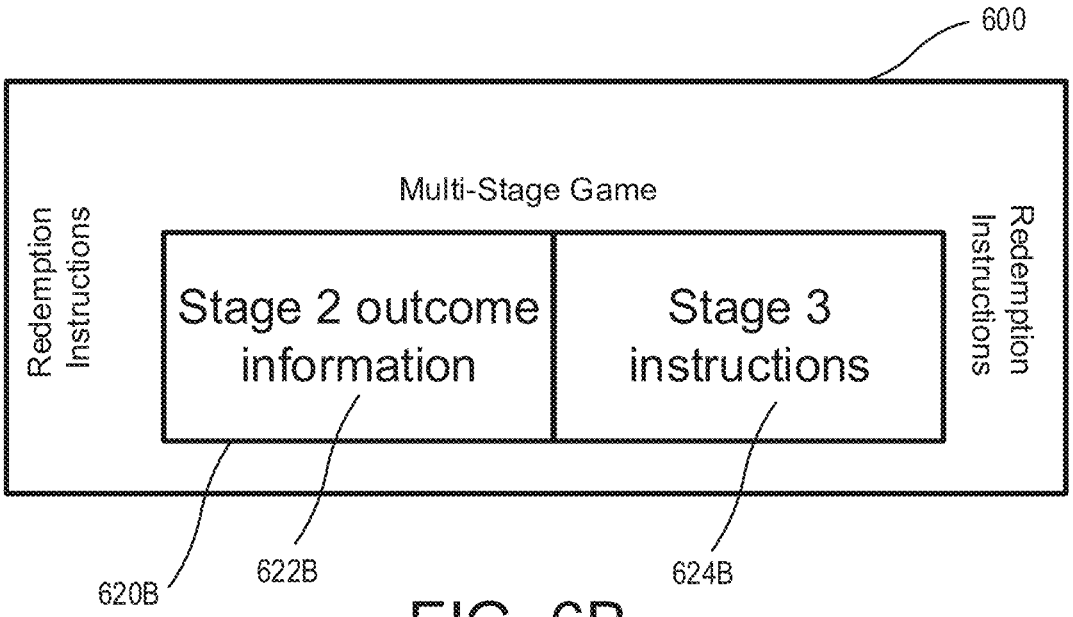
Figure 6C:
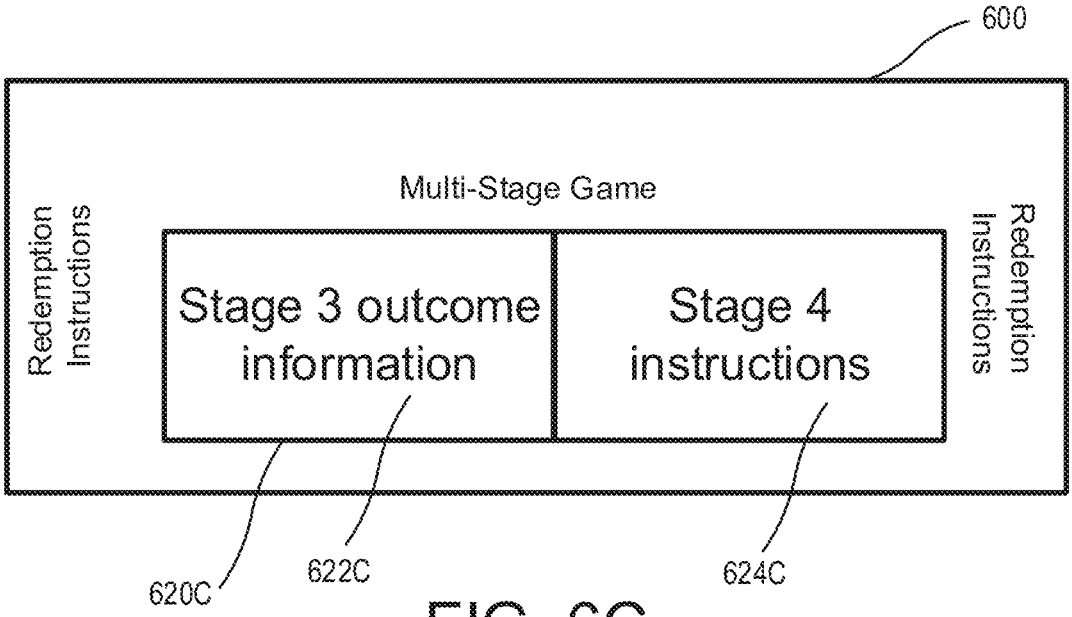

Reference is now made to FIGS. 6B and 6C, which illustrate the wagering ticket 600 at the second and third stages, respectively, of the multi-stage game. Referring to FIG. 6B, once the player has satisfied the instructions for getting to play the second stage of the multi-stage game, AR display content 620B may be displayed to the player. FIG. 6C illustrates the wagering ticket 600 once the player has satisfied the instructions for getting to play the third stage of the multi-stage game. Similar to the AR display content 620A, the AR display content 620B, 620C may include current stage virtual content 622B, 622C corresponding to the current stage of the multi-stage game and/or future stage virtual content 624B, 624C corresponding to the next stage of the multi-stage game. Some embodiments provide that the current stage virtual content 622B, 622C and/or the future stage virtual content 624B, 624C may be similar to the current stage virtual content 622A and/or the future stage virtual content 624A. Accordingly, duplicative discussion thereof will be omitted.

Figure 6D:
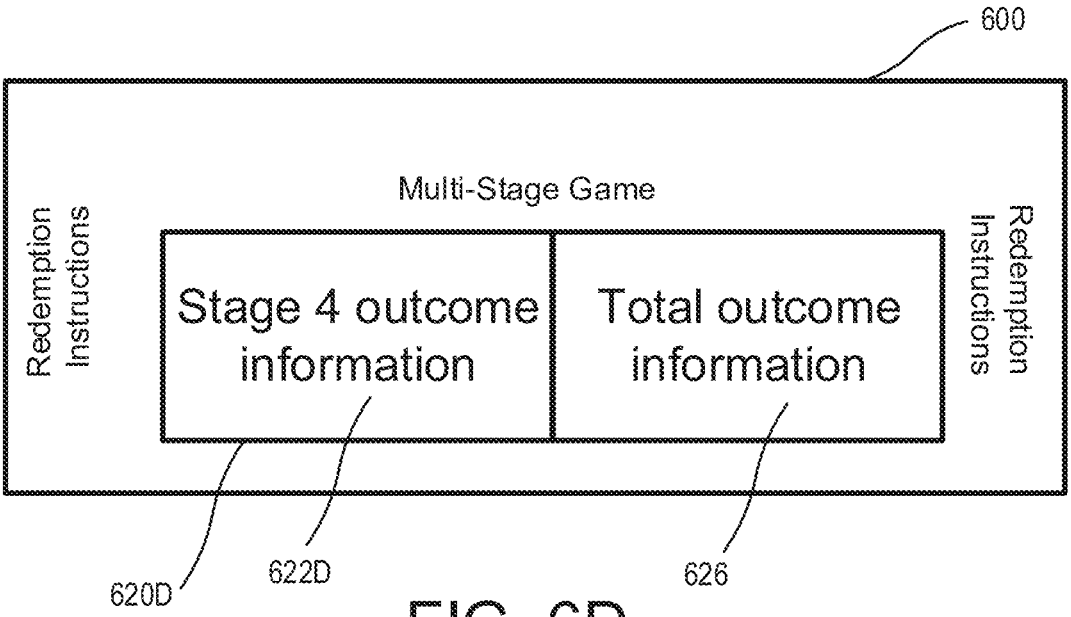

Reference is now made to FIG. 6D, which illustrates a wagering ticket 600 that includes AR display content 620D that corresponds to the last stage of the multi-stage game. Similar to the previous stages in the multi-stage game, the AR display content 620D may provide current stage virtual content 622D, which, in the current example, may include stage 4 outcome information. In some embodiments, the AR display content 620D may also include summary information 626 that includes total outcome information regarding all of the stages of the multi-stage game. For example, similar to the other portions of the AR display content 620A-D, the summary information 626 may include text, images and/or animations that convey to the player the winnings and/or awards corresponding to the multi-stage game. Some embodiments provide that potential awards corresponding to each of the stages of the multi-stage game may increase as the player advances to later stages in the game. By using the AR display content 620A-D in conjunction with the multi-stage wagering ticket 600, the player may be more engaged with the multi-stage game and thus be more incentivized to play.

Figure 7:
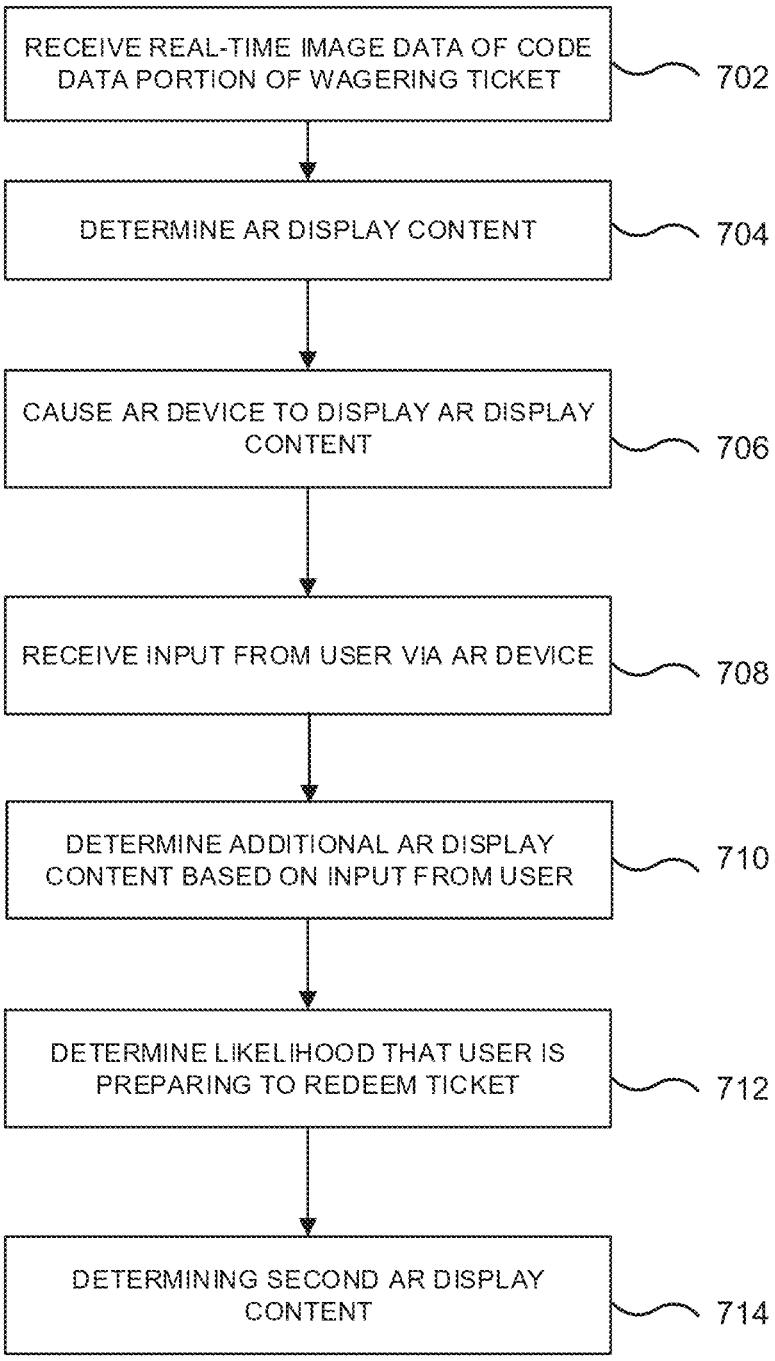
FIG. 7 is a flowchart illustrating operations of systems/methods according to some embodiments.

Reference is now made to FIG. 7, which is a flowchart illustrating operations of systems/methods according to some embodiments. Operations include receiving, via a communication interface and from an AR device, real-time image data of a code data portion of a wagering ticket that corresponds to a wagering event (block 702). In some embodiments, the real-time image data includes a representation of the code data portion of the wagering ticket as one of a one dimensional bar code and a two-dimensional matrix barcode. For example, some embodiments provide that the code data portion of the wagering ticket may be QR code or other multi-dimensional optically readable data code.

AR display content may be determined based on the code data portion of the wagering ticket (block 704). The AR display content is associated with the wagering event and is viewable by a user of the AR device. The AR device is caused to display the AR display content that is associated with the wagering event (block 706). A combined image corresponds to an image of the wagering ticket that is viewable through the AR device and the AR display content that is associated with the wagering event. In this manner, the AR display content may enhance the wagering ticket and thus potentially the wagering experience.

Some embodiments provide that the AR display content that is associated with the wagering event is determined based on the code data portion of the wagering ticket and a status of the wagering event. For example, the AR display content of a given wagering event may be different based on whether the status of the wagering event is started, pending and/or completed.

Some embodiments provide that the status of the wagering event includes multiple states that include a first wagering event state that is before the wagering event has commenced, a second wagering event state that is during the wagering event and a third wagering event state that is after the wagering event has ended. In such embodiments, the AR display content may include different display content corresponding to the different ones of the states. For example, the AR display content may include a first AR display content responsive to the status being the first wagering event state, a second AR display content responsive to the status being the second wagering event state and a third AR display content responsive to the status being the third wagering event state.

In some embodiments, the wagering event is a sporting event that is a contest between multiple competitors. The first AR display content may be AR display content that corresponds to the competitors. For example, in the context of a sporting event, the first AR display content may be symbols, pictures, videos, and/or animations of players, teams and/or mascots, among others.

The second AR display content may include AR display content that corresponds to a scoring data of the competitors. For example, the AR content may include a real-time score board, highlights of the game and/or replays of significant events occurring in the sporting event. Some embodiments provide that the AR content is dependent on the nature of the wager that is represented by the wagering ticket. For example, the AR display content may be tailored to users based on the outcome that the user desires.

The third AR display content may include AR display content that corresponds to an outcome of the wagering event. In such embodiments, the AR display content may depend on the outcome of the wager that is represented by the wagering ticket. For example, in response to the wagering ticket being a winning wagering ticket based on the outcome of the wagering event, the third AR display content may include celebration display data that includes an image and/or animation of the winning competitors participating in some action in the sporting event that resulted in the winning outcome. Some embodiments provide that in response to the wagering ticket being a losing wagering ticket based on the outcome of the wagering event, the third AR display content includes content for virtually damaging and/or destroying the wagering ticket.

In some embodiments, when the wagering ticket is a losing wagering ticket, the third AR display content includes content for selecting among multiple different methods for virtually damaging and/or destroying the wagering ticket. An input from the user may be received via a communication interface and may include a selection of one of the methods for virtually damaging the wagering ticket (block 708). Based on the received input, the selection of an option for virtually damaging the wagering ticket is determined (block 710).

Some embodiments include determining the AR display content based on the code data portion of the wagering ticket and a graphical portion of the wagering event. The graphical portion of the wagering event corresponds to an outcome of the wagering event and the AR display content includes the graphical portion of the wagering event.

In some embodiments, the AR display content includes a game for the user to play on the AR device. Some embodiments provide that a value corresponding to the wagering ticket is modified based on an outcome of the game for the user to play on the AR device. For example, if the user performs well in the game then the value of the wagering ticket may be increased more than if the user performs poorly in the game provided in the AR display content.

Operations may include determining that a user is preparing to redeem the wagering ticket (block 712). For example, the location and/or movement of the user within a casino may be determined based on a variety of location tracking methods. In the case that the user appears to be preparing to redeem the wagering ticket, second, different AR display content may be determined (block 714). The second AR display content may provide different and potentially more compelling content to try to get the player to continue and/or resume being engaged with a gaming device. For example, some embodiments provide that the different AR display content includes an identification of an award that may be associated with the wagering ticket responsive to the user registering the wagering ticket with a wagering station.

As discussed above regarding FIGS. 6A-6D, the wagering ticket may correspond to multiple wagers and the AR display content may include multiple different AR display content that corresponds to the different wagers. In some embodiments, the outcome corresponding to a first one of the wagers of the wagering ticket may be determined before an outcome of a second wager of the wagering ticket. Some embodiments provide that the outcome corresponding to the first wager may be determined at a first location and the outcome corresponding to the second wager may be determined at a second location that is different from the first location.

Some embodiments provide that the AR display content includes a game-independent symbol that may be unrelated to the wagering game but may be perceived by a user as bringing good luck or fortune. The AR display content may also include characters, numbers, and/or colors that are perceived to bring luck. Such lucky content may represent to users that there is an increased likelihood of a winning outcome in wagering events.

Figure 8:
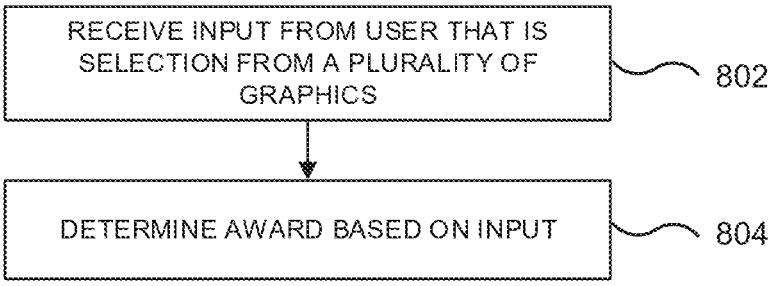
FIG. 8 is a flowchart illustrating operations of systems/methods according to some embodiments.

Brief reference is now made to FIG. 8, which is a flowchart illustrating operations of systems/methods according to some embodiments. Some embodiments provide that the AR display content includes instructions that guide the user to a given location in a casino. In response to the user going to the given location, the AR display content may include multiple virtual graphics that the user selects from. Operations may include receiving, via a communication interface, an input from the user, via the AR device, that is a selection of one of the plurality of virtual graphics (block 802). Based on the input that includes the selection of the virtual graphic, an award that corresponds to the AR display content may be awarded (block 804).

Figure 9:
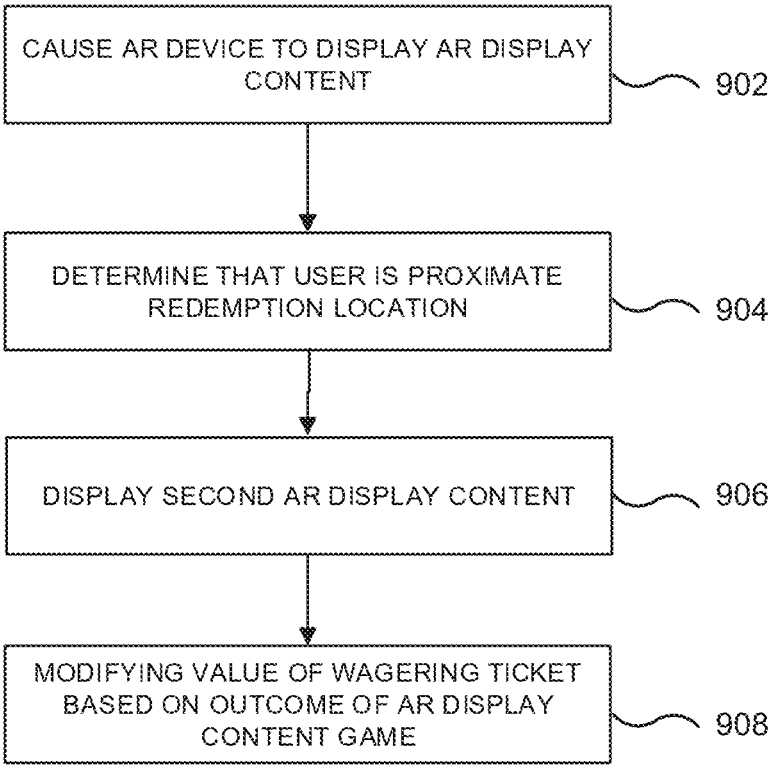
FIG. 9 is a flowchart illustrating operations of systems/methods according to some embodiments.

Reference is now made to FIG. 9, which is a flowchart illustrating operations of systems/methods according to some embodiments. Operations include causing an AR device to display first AR display content (block 902). The first AR display content may be displayed within a field of view of a user when the user is viewing image data of a code data portion of a wagering ticket that corresponds to a wagering event. The first AR display content may include a graphic that corresponds to the wagering event. A combined image is generated that corresponds to an image of the wagering ticket that is viewable through the AR device and the first AR display content that is associated with the wagering event. Operations may determine that the user is located proximate a redemption location that receives the wagering ticket (block 904). In response to determining that the user is proximate the redemption location, displaying a second AR display content that is different from the first AR display content to attract the user to a wagering station (block 906). In some embodiments, the second AR display content includes a game that the user may play. Based on the outcome of the AR display content game, the value of the wagering ticket may be modified (block 908).

Figure 10:
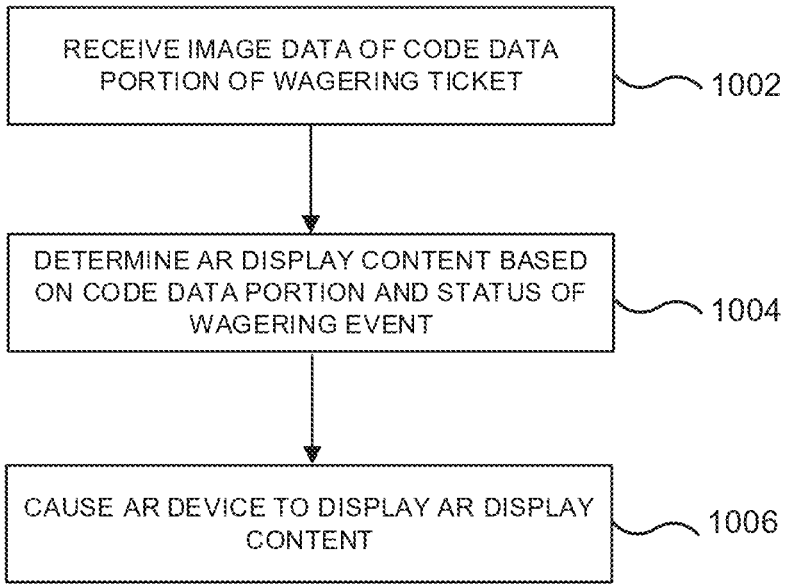
FIG. 10 is a flowchart illustrating operations of systems/methods according to some embodiments.

Reference is now made to FIG. 10, which is a flowchart illustrating operations of systems/methods according to some embodiments. Operations include receiving, via a communication interface and from an augmented reality (AR) device, real-time image data of a code data portion of a wagering ticket that corresponds to a wagering event (block 1002). AR display content that is associated with the wagering event and that is viewable by the user may be determined based on the code data portion of the wagering ticket and a status of the wagering event (block 1004). The AR device may be caused to display the AR display content that is associated with the wagering event (block 1006).

Some embodiments provide that the status of the wagering event includes a first wagering event state that is before the wagering event has commenced, a second wagering event state that is during the wagering event and a third wagering event state that is after the wagering event has ended. The AR display content may include a first AR display content responsive to the status being the first wagering event state, a second AR display content responsive to the status being the second wagering event state and a third AR display content responsive to the status being the third wagering event state.

AR Controller

Figure 11:
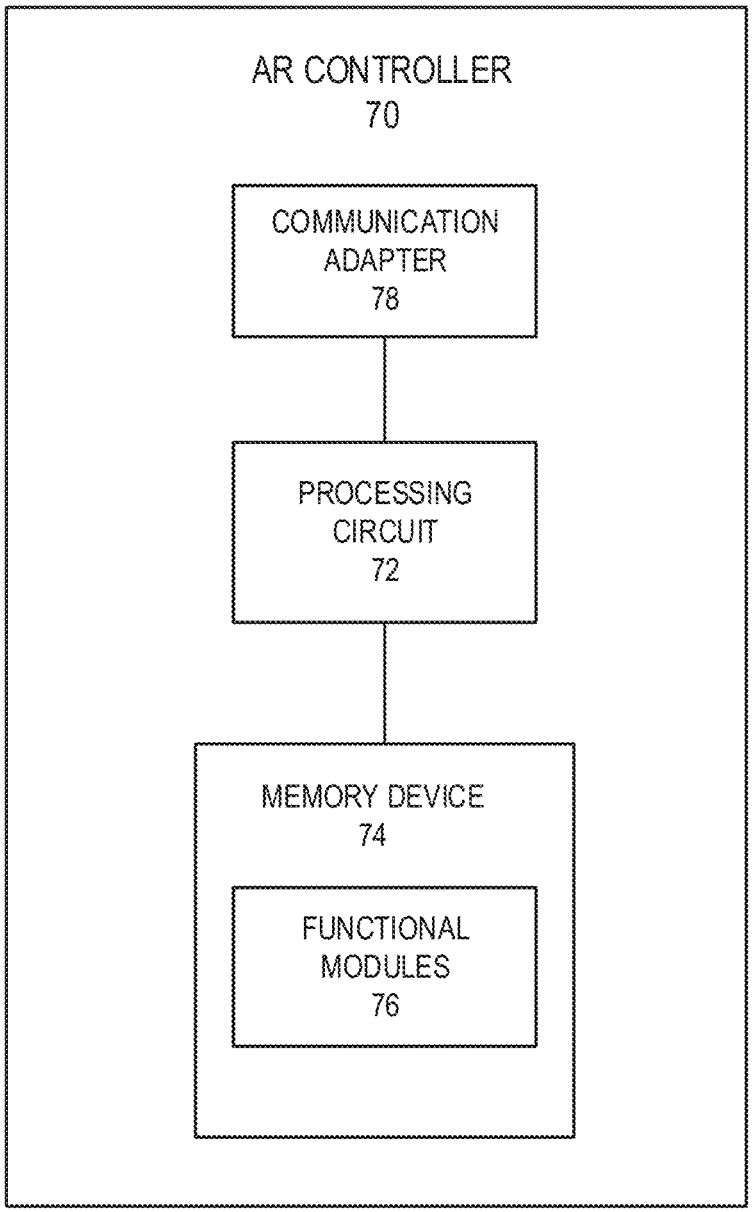
FIG. 11 is a schematic block diagram illustrating an electronic configuration for an augmented reality controller according to some embodiments.

FIG. 11 is a block diagram that illustrates various components of an AR controller 70 according to some embodiments. As shown in FIG. 11, the AR controller 70 may include a processing circuit 72 that controls operations of the AR controller 70. Although illustrated as a single processing circuit 72, multiple special purpose and/or general purpose processors and/or processor cores may be provided in the AR controller 70. For example, the AR controller 70 may include one or more of a video processor, a signal processor, a sound processor and/or a communication controller that performs one or more control functions within the AR controller 70. The processing circuit 72 may be variously referred to as a "controller," "microcontroller," "microprocessor" or simply a "computer." The processing circuit may further include one or more application-specific integrated circuits (ASICs).

Various components of the AR controller 70 are illustrated in FIG. 8 as being connected to the processing circuit 72. It will be appreciated that the components may be connected to the processing circuit 72 through a system bus, a communication bus and controller, such as a USB controller and USB bus, a network interface, or any other suitable type of connection.

The AR controller 70 further includes a memory device 74 that stores one or more functional modules 76 for performing the operations described above.

The memory device 74 may store program code and instructions, executable by the processing circuit 72, to control the AR controller 70. The memory device 74 may include random access memory (RAM), which can include non-volatile RAM (NVRAM), magnetic RAM (MRAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The AR controller 70 may include a communication adapter 78 that enables the AR controller 70 to communicate with remote devices, such as EGMs 100, coin pusher games 90 and/or a player tracking server 45 (FIG. 1) over a wired and/or wireless communication network, such as a local area network (LAN), wide area network (WAN), cellular communication network, or other data communication network.

The AR controller 70 may include one or more internal or external communication ports that enable the processing circuit 72 to communicate with and to operate with internal or external peripheral devices, such as display screens, keypads, mass storage devices, microphones, speakers, and wireless communication devices. In some embodiments, internal or external peripheral devices may communicate with the processing circuit 72 through a universal serial bus (USB) hub (not shown) connected to the processing circuit 72.

Other EGM Features

Embodiments described herein may be implemented in various configurations for EGMs 100*s*, including but not limited to: (1) a dedicated EGM, wherein the computerized instructions for controlling any games (which are provided by the EGM) are provided with the EGM prior to delivery to a gaming establishment; and (2) a changeable EGM, where the computerized instructions for controlling any games (which are provided by the EGM) are downloadable to the EGM through a data network when the EGM is in a gaming establishment. In some embodiments, the computerized instructions for controlling any games are executed by at least one central server, central controller or remote host. In such a "thin client" embodiment, the central server remotely controls any games (or other suitable interfaces) and the EGM is utilized to display such games (or suitable interfaces) and receive one or more inputs or commands from a player. In another embodiment, the computerized instructions for controlling any games are communicated from the central server, central controller or remote host to a EGM local processor and memory devices. In such a "thick client" embodiment, the EGM local processor executes the communicated computerized instructions to control any games (or other suitable interfaces) provided to a player.

In some embodiments, an EGM may be operated by a mobile device, such as a mobile telephone, tablet other mobile computing device. For example, a mobile device may be communicatively coupled to an EGM and may include a user interface that receives user inputs that are received to control the EGM. The user inputs may be received by the EGM via the mobile device.

In some embodiments, one or more EGMs in a gaming system may be thin client EGMs and one or more EGMs in the gaming system may be thick client EGMs. In another embodiment, certain functions of the EGM are implemented in a thin client environment and certain other functions of the EGM are implemented in a thick client environment. In one such embodiment, computerized instructions for controlling any primary games are communicated from the central server to the EGM in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal EGMs, such as desktop computers, laptop computers, tablet computers or computing devices, personal digital assistants (PDAs), mobile telephones such as smart phones, and other mobile computing devices.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In some embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

Embodiments provided herein may provide improved accessibility to wagering stations by including additional user interface technologies, such as augmented reality. Such embodiments may improve technological efficiency by coordinating the augmented reality with examples of different types of wagering stations.

FURTHER DEFINITIONS AND EMBODIMENTS

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product comprising one or more computer readable media having computer readable program code embodied thereon.

Any combination of one or more computer readable media may be used. The computer readable media may be a computer readable signal medium or a non-transitory computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible non-transitory medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processing circuit of a general purpose computer, special purpose computer, or other programmable data processing apparatus to produce a machine, such that the instructions, which execute via the processing circuit of the computer or other programmable instruction execution apparatus, create a mechanism for implementing the functions/acts specified in the flowchart and/or block diagram block or blocks.

These computer program instructions may also be stored in a non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A system comprising:

a communication interface;

a processing circuit; and a memory coupled to the processing circuit, the memory comprising machine readable instructions that, when executed by the processing circuit, cause the processing circuit to:

receive, via the communication interface and from an augmented reality (AR) device, real-time image data of a code data portion of a wagering ticket that corresponds to a wagering event;

determine a first state of the wagering event from a set of wagering event states;

determine, based on the code data portion of the wagering ticket and the first state, AR display content that is associated with the wagering event and that is viewable by a user of the AR device; and cause the AR device to display the AR display content that is associated with the wagering event, wherein a combined image corresponds to an image of the wagering ticket that is viewable through the AR device and the AR display content that is associated with the wagering event.

2. The system of claim 1, wherein a representation of the code data portion of the wagering ticket is a barcode that comprises data content that is optically readable across a dimension of the barcode.

3. The system of claim 1, wherein the set of wagering event states comprises a first wagering event state that is before the wagering event has commenced, a second wagering event state that is during the wagering event and a third wagering event state that is after the wagering event has ended, and wherein the AR display content comprises a first AR display content responsive to the first state being the first wagering event state, a second AR display content responsive to the first state being the second wagering event state and a third AR display content responsive to the first state being the third wagering event state.

4. The system of claim 3, wherein the wagering event comprises a sporting event that is a contest between a plurality of competitors, wherein the first AR display content comprises AR display content that corresponds to the plurality of competitors, wherein the second AR display content comprises AR display content that corresponds to a scoring data of the plurality of competitors, and wherein the third AR display content comprises AR display content that corresponds to an outcome of the wagering event.

5. The system of claim 4, wherein, responsive to the wagering ticket being a winning wagering ticket based on the outcome of the wagering event, the third AR display content comprises celebration display data that comprises an image corresponding to one of the plurality of competitors, wherein the image corresponding to the one of the plurality of competitors was captured during the wagering event, and wherein, responsive to the wagering ticket being a losing wagering ticket based on the outcome of the wagering event, the third AR display content comprises AR display content that depicts virtually damaging the wagering ticket.

6. The system of claim 5, wherein, responsive to the wagering ticket being a losing wagering ticket based on the outcome of the wagering event, the third AR display content comprises AR display content comprising a plurality of methods for virtually damaging the wagering ticket, wherein the processing circuit is further caused to:

receive, via the communication interface, an input from the user, via the AR device, that comprises a selection of one of the plurality of methods for virtually damaging the wagering ticket;

determine, based on the input that comprises the selection of the one of the plurality of options for virtually damaging the wagering ticket, the third AR display content that comprises the one of the plurality of options for virtually damaging the wagering ticket; and cause the AR device to display the third AR display content.

7. The system of claim 1, wherein causing the processing circuit to determine the AR display content that is associated with the wagering event further determines the AR display content based on the code data portion of the wagering ticket and a graphical portion of the wagering event, wherein the graphical portion of the wagering event corresponds to an outcome of the wagering event, and wherein the AR display content comprises the graphical portion of the wagering event.

8. The system of claim 1, wherein the AR display content comprises a game for the user to play on the AR device.

9. The system of claim 8, wherein a value corresponding to the wagering ticket is modified based on an outcome of the game for the user to play on the AR device.

10. The system of claim 1, wherein the AR display content comprises a first AR display content, and wherein the processing circuit is further caused to:

determine a likelihood that the user is preparing to redeem the wagering ticket based on location data that is received from the AR device;

responsive to determining that the user is likely to be preparing to redeem the ticket, determine a second AR display content that includes display content to attract the user to a wagering station; and cause the AR device to display the second AR content.

11. The system of claim 10, wherein the second AR display content comprises an indication corresponding to an award to be associated with the wagering ticket responsive to the user registering the wagering ticket with the wagering station.

12. The system of claim 1, wherein the wagering ticket corresponds to a plurality of wagers that comprises a first wager and a second wager, wherein the AR display content comprises a first AR display content that corresponds to the first wager and a second AR display content that corresponds to the second wager.

13. The system of claim 12, wherein an outcome of the first wager of the wagering ticket is determined before an outcome of the second wager, wherein a first location for determining the outcome of the first wager is different from a second location for determining the outcome of the second wager, and wherein the second AR display content corresponds to the second location for determining the outcome of the second wager to the user.

14. The system of claim 12, wherein the plurality of wagers further comprises a third wager, wherein the AR display content comprises a third AR display content that corresponds to the third wager, wherein a first award value that corresponds to the first wager is less than a second award value that corresponds to the second wager, and wherein the second award value that corresponds to the second wager is less than a third award value that corresponds to the third wager.

15. The system of claim 1, wherein the AR display content comprises a game independent symbol that represents a likelihood of a winning outcome in wagering events.

16. The system of claim 1, wherein the AR display content comprises:

instructions that guide the user to a given location in a casino; and responsive to the user going to the given location, a plurality of virtual graphics that the user selects from, and wherein the processing circuit is further caused to: receive, via the communication interface, an input from the user, via the AR device, that comprises a selection of one of the plurality of virtual graphics; and determine, based on the input that comprises the selection of the one of the plurality of virtual graphics, an award that corresponds to the AR display content.

17. An augmented reality (AR) system comprising:

a processing circuit;

a transceiver coupled to the processing circuit; and a display device coupled to the processing circuit and that the processing circuit causes to display AR display content within a field of view of a user when the user is viewing image data of a code data portion of a wagering ticket, wherein the AR display content is selected based, at least in part, on the code data portion and a first state of a set of a wagering event states corresponding to a wagering event associated with the wagering ticket, wherein the AR display content comprises a graphic that corresponds to the wagering ticket, and wherein a combined image corresponds to an image of the wagering ticket that is viewable through the AR device and the AR display content.

18. The system of claim 17, wherein the AR display content comprises a first AR display content, and wherein the processing circuit is further caused to:

determine that the user is located proximate a redemption location that receives the wagering ticket; and responsive to determining that the user is proximate the redemption location, displaying a second AR display content that includes display content to attract the user to a wagering station.

19. The system of claim 17, wherein the set of wagering event states comprises a first wagering event state that is before the wagering event has commenced, a second wagering event state that is during the wagering event and a third wagering event state that is after the wagering event has ended, and wherein the AR display content comprises a first AR display content responsive to the first state being the first wagering event state, a second AR display content responsive to the first state being the second wagering event state and a third AR display content responsive to the first state being the third wagering event state.

20. A method comprising:

receiving, via a communication interface and from an augmented reality (AR) device, real-time image data of a code data portion of a wagering ticket that corresponds to a wagering event;

determining, based on the code data portion of the wagering ticket and a status of the wagering event, AR display content that is associated with the wagering event and that is viewable by a user of the AR device; and causing the AR device to display the AR display content that is associated with the wagering event, wherein the wagering event comprises a first wagering event state that is before the wagering event has commenced, a second wagering event state that is during the wagering event and a third wagering event state that is after the wagering event has ended, wherein the AR display content comprises a first AR display content responsive to the status being the first wagering event state, a second AR display content responsive to the status being the second wagering event state and a third AR display content responsive to the status being the third wagering event state, and wherein a combined image corresponds to an image of the wagering ticket that is viewable through the AR device and the AR display content that is associated with the wagering event.

* * * * *